US009450323B2

(12) United States Patent
Ohkubo et al.

(10) Patent No.: US 9,450,323 B2
(45) Date of Patent: Sep. 20, 2016

(54) TERMINAL FITTING CONNECTION STRUCTURE AND ROTARY FITTING-TYPE CONNECTOR

(71) Applicant: Yazaki Corporation, Tokyo (JP)

(72) Inventors: Yoshitaka Ohkubo, Kakegawa (JP); Hiroaki Imai, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/960,850

(22) Filed: Dec. 7, 2015

(65) Prior Publication Data

US 2016/0087365 A1 Mar. 24, 2016

Related U.S. Application Data

(63) Continuation of application No. PCT/JP2014/067675, filed on Jul. 2, 2014.

(30) Foreign Application Priority Data

Jul. 2, 2013 (JP) ..... 2013-139097

(51) Int. Cl.

| | |
|---|---|
| ***H01R 13/28*** | (2006.01) |
| ***H01R 13/42*** | (2006.01) |
| ***H01R 4/48*** | (2006.01) |
| ***H01R 35/04*** | (2006.01) |
| ***H01R 24/00*** | (2011.01) |
| *H01R 13/627* | (2006.01) |
| *H01R 101/00* | (2006.01) |

(52) U.S. Cl.

CPC ..... *H01R 13/42* (2013.01); *H01R 4/48* (2013.01); *H01R 24/005* (2013.01); *H01R 35/04* (2013.01); *H01R 13/6278* (2013.01); *H01R 2101/00* (2013.01)

(58) Field of Classification Search

CPC .... H01R 13/28; H01R 13/20; H01R 13/213; H01R 13/22; H01R 13/625; H01R 2101/00

USPC ..... 439/288–290, 332, 333

See application file for complete search history.

(56) References Cited

U.S. PATENT DOCUMENTS 5,431,580 A 7/1995 Tabata
5,529,509 A * 6/1996 Hayes ..... H01R 11/12 439/288

(Continued)

FOREIGN PATENT DOCUMENTS

| | | | |
|---|---|---|---|
| EP | 2065982 | A1 | 6/2009 |
| JP | S51 68389 | | 5/1976 |
| JP | S57 179274 | | 11/1982 |
| JP | H6 295760 | A | 10/1994 |
| JP | H9 232019 | A | 9/1997 |
| JP | 2000 277197 | A | 10/2000 |
| JP | 2011 228061 | A | 11/2011 |

OTHER PUBLICATIONS

Translation of International Preliminary Report on Patentabilitydated Jan. 14, 2016, issued by the International Searching Authority in counterpart International Application No. PCT/JP2014/067675 (PCT/IB/338, PCT/IB/373 & PCT/ISA/237).

International Search Report (PCT/ISA/210, 220, 237) dated Sep. 22, 2014, issued by the International Searching Authority in counterpart International Application No. PCT/JP2014/067675.

*Primary Examiner* — Hien Vu

(74) *Attorney, Agent, or Firm* — Sughrue Mion, PLLC

(57) ABSTRACT

A second terminal fitting which abuts and is connected to a first terminal fitting includes a second annular portion formed at the tip end of a second terminal body which extends on a center axis thereof, a plurality of contact surfaces which protrude from the outer periphery of the second annular portion at the same intervals as those of a plurality of contact protrusions in the first terminal fitting, and a plurality of contact release portions which are positioned between the adjacent contact surfaces.

5 Claims, 21 Drawing Sheets

(56) References Cited

U.S. PATENT DOCUMENTS 5,558,531 A * 9/1996 Ikeda ..... H01R 13/28 439/287
5,759,056 A * 6/1998 Costello ..... H01R 11/12 439/290
5,834,696 A 11/1998 Kurosawa et al.
5,865,638 A * 2/1999 Trafton ..... H01R 11/12 439/288
6,409,531 B1 * 6/2002 Millard ..... H01R 13/22 439/289

* cited by examiner

TERMINAL FITTING CONNECTION STRUCTURE AND ROTARY FITTING-TYPE CONNECTOR

CROSS REFERENCE TO RELATED APPLICATIONS

This application is a continuation of PCT application No. PCT/JP2014/067675, which was filed on Jul. 2, 2014 based on Japanese Patent Application (No. 2013-139097) filed on Jul. 2, 2013, the contents of which are incorporated herein by reference.

BACKGROUND OF THE INVENTION

1. Field of the Invention

The present invention relates to a terminal fitting connection structure, and a rotary fitting type connector which electrically connects terminal fittings to each other using the terminal fitting connection structure.

2. Description of the Related Art

FIG. 29 illustrates a terminal fitting connection structure disclosed in PTL 1 as below, and FIG. 30 illustrates a terminal fitting connection structure disclosed in PTL 2 as below.

In the terminal fitting connection structure of PTL 1, a contact spring piece 111 provided in a first terminal fitting 110 comes into pressing contact with a contact surface 121 provided in a second terminal fitting 120 such that the first terminal fitting 110 and the second terminal fitting 120 enter a state of being electrically connected to each other.

The first terminal fitting 110 in PTL 1 is a female type terminal fitting formed by press forming of a metal plate, and includes an electric wire connection portion 112 which clamps and connects an electric wire, and a fitting portion 113 having a rectangular tube shape to which the tip end portion of a male type terminal fitting is fitted. The fitting portion 113 having a rectangular tube shape nips the tip end portion of the male type terminal fitting between the contact spring piece 111, which is bent toward the inside of the rectangular tube from the front end of a lower wall portion 114 and extends in the axial direction of the first terminal fitting 110, and an upper wall portion 115 which opposes the contact spring piece 111. A contact portion 111*a* which comes into contact with the contact surface 121 is formed to protrude from the contact spring piece 111.

The second terminal fitting 120 in PTL 1 is a male type terminal fitting formed by press forming of a metal plate, and includes an electric wire connection portion 122 which clamps and connects an electric wire, and a tongue-shaped tip end portion 123 which is inserted into the fitting portion 113 of the first terminal fitting 110. The surface of the tongue-shaped tip end portion 123 functions as the contact surface 121 which comes into pressing contact with the contact spring piece 111.

In the terminal fitting connection structure of PTL 2, a contact spring piece 131 provided in a first terminal fitting 130 comes into pressing contact with a contact surface 141 provided in a second terminal fitting 140 such that the first terminal fitting 130 and the second terminal fitting 140 enter a state of being electrically connected to each other.

The first terminal fitting 130 in PTL 2 is a female type terminal fitting, and includes a substantially cylindrical barrel portion 132 which clamps and connects an electric wire, and a substantially cylindrical fitting portion 133 to which the tip end portion of a male type terminal fitting is fitted. The fitting portion 133 is formed of slits 134 formed at four points separated in the peripheral direction of the cylinder. Peripheral wall portions which are separated by the slits 134 and extend in the axial direction of the first terminal fitting 130 function as contact spring pieces 131 which can be deformed to be bent in the radial direction of the cylinder. A contact portion 131*a* which comes into contact with the contact surface 141 is formed to protrude from the inner surface of each of the peripheral wall portions that function as the contact spring pieces 131.

The second terminal fitting 140 in PTL 2 is a male type terminal fitting, and includes a substantially cylindrical barrel portion 142 which clamps and connects an electric wire, and a round bar-shaped tip end portion 143 which is inserted into the fitting portion 133 of the first terminal fitting 130. The outer peripheral surface of the tip end portion 143 functions as the contact surface 141 which comes into pressing contact with the contact spring piece 131.

[PTL 1] JP-A-2000-277197

[PTL 2] JP-A-2011-228061

SUMMARY OF THE INVENTION

However, in the case of the terminal fitting connection structure of any of PTLs 1 and 2, the contact spring piece 111 extends in the axial direction of the terminal fitting. Therefore, when a sufficient length for the contact spring piece 111 is ensured in order to ensure stable flexibility for the contact spring piece 111, the axial length of the terminal fitting is increased, and there is a problem in that an increase in the size of the terminal fitting or an increase in the size of a connector which accommodates the terminal fitting is incurred.

In addition, in the case of the terminal fitting connection structure of any of PTLs 1 and 2, the contact areas between the contact surfaces 121 and 141 and the contact portions 111*a* and 131*a* are small, and thus there is a problem in that it is difficult to reduce the conductor resistance in contact portions of the terminal fittings.

Here, an object of the present invention is to provide a terminal fitting connection structure capable of achieving reduction in the size of a connector which accommodates terminal fittings by reducing the axial length of the terminal fittings, and of enhancing the reliability of electrical connection by reducing the conductor resistance in contact portions of the terminal fittings, and to provide a rotary fitting type connector capable of realizing a reduction in size by electrically connecting the terminal fittings to each other using the terminal fitting connection structure.

The above-mentioned object of the present invention is accomplished by the following configurations.

(1) A terminal fitting connection structure which presses contact spring pieces provided in a first terminal fitting to contact surfaces provided in a second terminal fitting so as to contact thereto, so that the first terminal fitting and the second terminal fitting are electrically connected to each other, wherein the first terminal fitting includes:

a first terminal body which extends on a center axis of the first terminal fitting and has a base end to which an electric wire is connected substantially coaxially with the center axis of the first terminal fitting, a first annular portion which is formed at a tip end of the first terminal body in an annular shape concentrically with the center axis of the first terminal fitting, and a plurality of the contact spring pieces which are provided at a plurality of points arranged on an outer periphery of the first annular portion at predetermined intervals in a peripheral direction of the first annular portion, the contact spring piece includes:

a spring support portion which extends outward in a radial direction of the first annular portion from the outer periphery of the first annular portion, an elastic piece which extends from the spring support portion along the outer periphery of the first annular portion and has a tip end side that is displaceable in a direction of the center axis of the first terminal fitting, and a contact protrusion which protrudes from the elastic piece so as to protrude further toward a mated terminal side than a tip end of the first annular portion, and the second terminal fitting includes:

a second terminal body which extends on a center axis of the second terminal fitting and has a base end to which an electric wire is connected substantially coaxially with the center axis of the second terminal fitting, a second annular portion which is provided at a tip end of the second terminal body in the same annular shape as that of the first annular portion of the first terminal fitting concentrically with the center axis of the second terminal fitting, a plurality of the contact surfaces which protrude outward in a radial direction of the second annular portion from an outer periphery of the second annular portion at the same intervals as those of the plurality of the contact protrusions in the first terminal fitting, and a plurality of contact release portions which are positioned between the adjacent contact surfaces and allow the contact protrusions to be inserted into the contact release portions.

(2) The terminal fitting connection structure described in (1), in which the plurality of the contact surfaces of the second terminal fitting are provided with recessed portions to which the contact protrusions that ride on the contact surfaces are fitted.

(3) The terminal fitting connection structure described in (1) or (2), in which one side edge of each of the plurality of the contact surfaces of the second terminal fitting, which faces the contact release portion, is provided with an inclined surface which guides the contact protrusion that is inserted into the contact release portion onto the contact surface.

(4) The terminal fitting connection structure described in any one of (1) to (3), in which an arrangement of the contact protrusions and the contact surfaces is set so that portions of the plurality of the contact protrusions provided in the first terminal fitting ride on the contact surfaces of the second terminal fitting at timings different from those of the other contact protrusions.

(5) A rotary connector which allows terminal fittings to enter a state of being electrically connected to each other by using the terminal fitting connection structure described in any one of (1) to (4), the rotary connector comprising:

a first connector housing which includes a first housing body which fixes and supports the first terminal fitting on a center axis so as to expose a tip end portion of the first terminal fitting that is fixed and supported from a front end of the first housing body, and has a circular section that is concentric with the center axis, and a connection pin which protrudes from the first housing body along a radial direction thereof; and a second connector housing which includes a second housing body which fixes and supports the second terminal fitting on the center axis so as to expose a tip end portion of the second terminal fitting that is fixed and supported from a front end of the second housing body, has a circular section that is concentric with the center axis, and is fitted to the first housing body, an axial groove which is cut out from an end portion of the second housing body on the first connector housing side so as to extend along a center axis direction of the second housing body, and allows the connection pin to be inserted into the axial groove when the first housing body is fitted to the second housing body along the center axis direction of the second housing body, a peripheral groove which extends from an end of the axial groove toward one side in a peripheral direction of the second housing body along the peripheral direction to have a predetermined length, and allows the connection pin to move in the peripheral groove when the first housing body and the second housing body are rotated relative to each other, and a locking portion which comes into contact with the connection pin from a start side of the peripheral groove when the connection pin reaches an end of the peripheral groove and restricts movement of the connection pin in a return direction, thereby locking a joined state of the connector housings.

According to the configuration of (1), the first terminal fitting and the second terminal fitting are allowed to face each other so as to enable the contact protrusions of the plurality of the contact spring pieces of the first terminal fitting and the plurality of the contact release portions of the second terminal fitting to oppose each other. Next, the first terminal fitting and the second terminal fitting are allowed to abut each other on the same axis so as to allow the plurality of the contact protrusions of the first terminal fitting to be inserted into the plurality of the contact release portions of the second terminal fitting. Thereafter, in the state in which the two terminal fittings abut each other, when the first terminal fitting and the second terminal fitting are rotated relative to each other by a predetermined angle on the same axis, the contact protrusions of the plurality of the contact spring pieces of the first terminal fitting ride on the plurality of the contact surfaces of the second terminal fitting. Accordingly, the contact protrusions of the plurality of the contact spring pieces of the first terminal fitting enter a state of coming into pressing contact with the plurality of the contact surfaces of the second terminal fitting, and thus the first terminal fitting and the second terminal fitting enter the electrically connected state.

In addition, according to the configuration of (1), the contact spring pieces extend in the peripheral direction of the first annular portion at the tip end of the first terminal fitting. That is, the contact spring piece is configured to extend in an arc shape on a plane perpendicular to the axial direction of the first terminal fitting. Therefore, even when a sufficient length for the contact spring piece is ensured in order to ensure stable flexibility for the contact spring piece, the dimensions of the terminal fittings in the axial direction are not affected.

Therefore, even in a case where a necessary and sufficient length for the contact spring piece is ensured, the axial length of the terminal fittings is reduced, resulting in a reduction in the size of the terminal fittings. In addition, due to a reduction in the size of the terminal fittings, a reduction in the size of a connector that accommodates the terminal fittings can be achieved.

In addition, according to the configuration of (1), the electrical connection between the first terminal fitting and the second terminal fitting is achieved by contact between the plurality of the contact protrusions and the plurality of the contact surfaces, and thus the total contact area of the contact portions of the terminal fittings is increased. Therefore, the conductor resistance in the contact portions is decreased, and thus the reliability of the electrical connection can be enhanced.

In addition, the first annular portion and the second annular portion in the configuration of (1) may be a hollow annular portion or may also be a solid annular portion.

According to the configuration of (2), the contact protrusion that rides on the contact surface is fitted to the recessed portion provided in the contact surface such that the recessed portion restricts the movement of the contact protrusion. Therefore, slipping of the contact protrusion on the contact surface due to external vibration transmitted from the electric wires and the like connected to the terminal fittings can be prevented. As a result, the occurrence of problems such as wear or a reduction in contact pressure caused by the slipping of the contact protrusion on the contact surface can be prevented.

According to the configuration of (3), when the contact protrusions of the first terminal fitting that are inserted into the contact release portions of the second terminal fitting ride on the contact surfaces of the second terminal fitting by the relative rotation between the first terminal fitting and the second terminal fitting, since the contact protrusions move on the inclined surface connected to the contact surface, the contact protrusion does not abruptly collide with the edge of the contact surface. Furthermore, the bending deformation amount of the contact spring piece which occurs when the contact protrusion rides on the contact surface is gradually changed. Therefore, a rotating operation force for the contact protrusion of the first terminal fitting to ride on the contact surface of the second terminal fitting can be reduced, and the operability during a rotating operation can be enhanced.

According to the configuration of (4), compared to a case in which all of the plurality of the contact protrusions provided in the first terminal fitting simultaneously ride on the corresponding contact surfaces of the second terminal fitting, as the number of contact protrusions that simultaneously ride on the contact surfaces is reduced, the rotating operation force applied between the two terminal fittings is reduced, and thus operability can be enhanced.

According to the configuration of (5), since the first terminal fitting and the second terminal fitting accommodated in the corresponding connector housings are as described in (1) to (4), the axial lengths of the terminal fittings can be reduced. Therefore, as the axial lengths of the terminal fittings are reduced, the axial lengths of the connector housings can also be reduced. Accordingly, a reduction in the size of the connector is achieved, and thus a mountable ability thereof in a vehicle that is difficult to ensure a sufficient installation space can be enhanced.

In addition, the terminal fittings which are accommodated in the corresponding connector housings are fixed on the center axes of the connector housings. Therefore, the axial movement of the connector housings and the rotating operation of the connector housings around the center axes become the axial movement and the rotating operation of the terminal fittings which are accommodated in the connector housings. On the other hand, moving two in an axial direction from a state in which the two face each other on the same axis so as to allow the two to abut each other, and then rotating the two that abut each other relative to each other by a predetermined angle are common to both a necessary operation for joining the connector housings included in the connector and a necessary operation for electrically connecting the terminal fittings to each other.

Therefore, by allowing a necessary relative rotation angle for a transition of the connector housings from an abutting state to a lock completed state to be the same as a necessary relative rotation angle for a transition from an abutting state in which the contact protrusions of the first terminal fitting are inserted into the contact release portions of the second terminal fitting to the electrically connected state in which the contact protrusions of the first terminal fitting ride on the contact surfaces of the second terminal fitting, when the joining of the connector housings and is locked, the terminal fittings which are respectively accommodated in the connector housings simultaneously can be allowed to enter the electrically connected state.

According to the terminal fitting connection structure in the present invention, a reduction in the size of a connector which accommodates terminal fittings can be achieved by reducing the axial length of the terminal fittings, and the reliability of electrical connection can be enhanced by reducing the conductor resistance in contact portions of the terminal fittings.

In addition, in the rotary connector according to the present invention, a mountable ability of the connector in a vehicle can be enhanced by realizing a reduction in the size of the connector, and when the joining of the connector housings is locked, the terminal fittings which are respectively accommodated in the connector housings simultaneously can be allowed to enter the electrically connected state.

Hereinabove, the present invention has been concisely described. Furthermore, the details of the present invention will become more apparent by reading through embodiments for embodying the invention described below (hereinafter, referred to as "embodiments") with reference to the accompanying drawings.

BRIEF DESCRIPTION OF THE DRAWINGS

FIGS. 25A to 25D are explanatory views of a transition of the connected state during relative rotation between the second terminal fitting of the third embodiment and the first terminal fitting, in which FIG. 25A is an explanatory view of the connected state in an initial abutting state of the terminal fittings, FIG. 25B is an explanatory view of the connected state in a first stage transited from FIG. 25A by predetermined relative rotation, FIG. 25C is an explanatory view of the connected state in a second stage transited from FIG. 25B by predetermined relative rotation, and FIG. 25D is an explanatory view of a connection completed state transited from FIG. 25C by predetermined relative rotation.

DETAILED DESCRIPTION OF THE EXEMPLARY EMBODIMENTS

Figure 1:
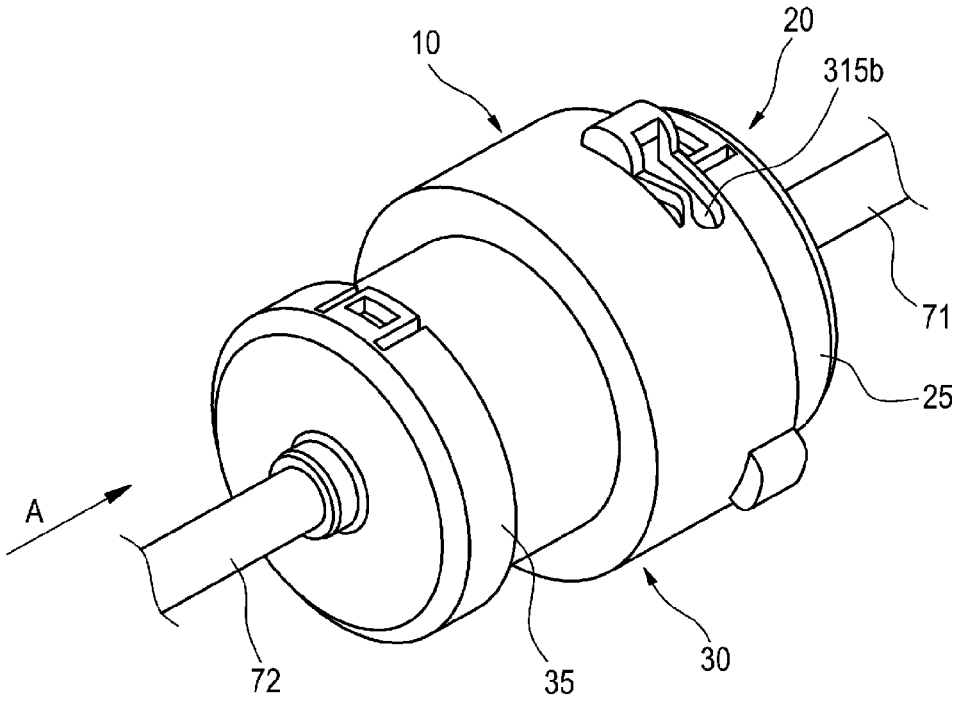
FIG. 1 is a perspective view of an assembled state of a first embodiment of a rotary connector according to the present invention.

Hereinafter, embodiments of a terminal fitting connection structure and a rotary fitting type connector according to the present invention will be described in detail with reference to the drawing.

First Embodiment

First, after initially describing a rotary connector 10 of a first embodiment, a terminal fitting connection structure of the first embodiment will be described in detail.

Description of Rotary Connector 10 of First Embodiment

Figure 2:
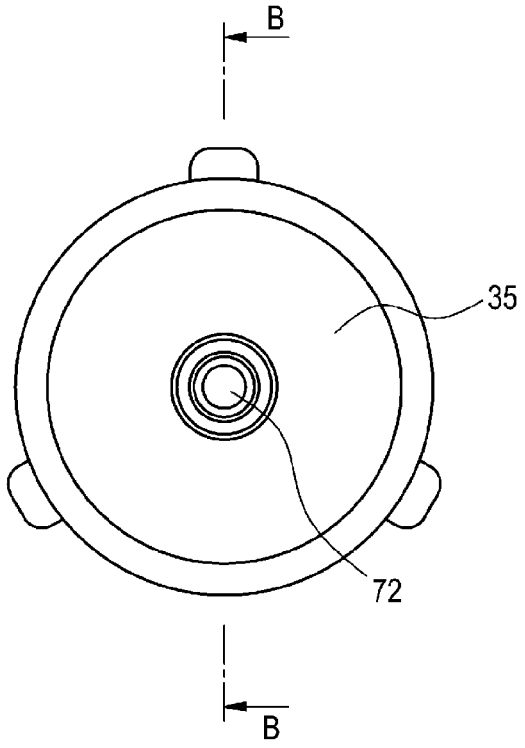
FIG. 2 is a view viewed from arrow A of FIG. 1.
Figure 3:
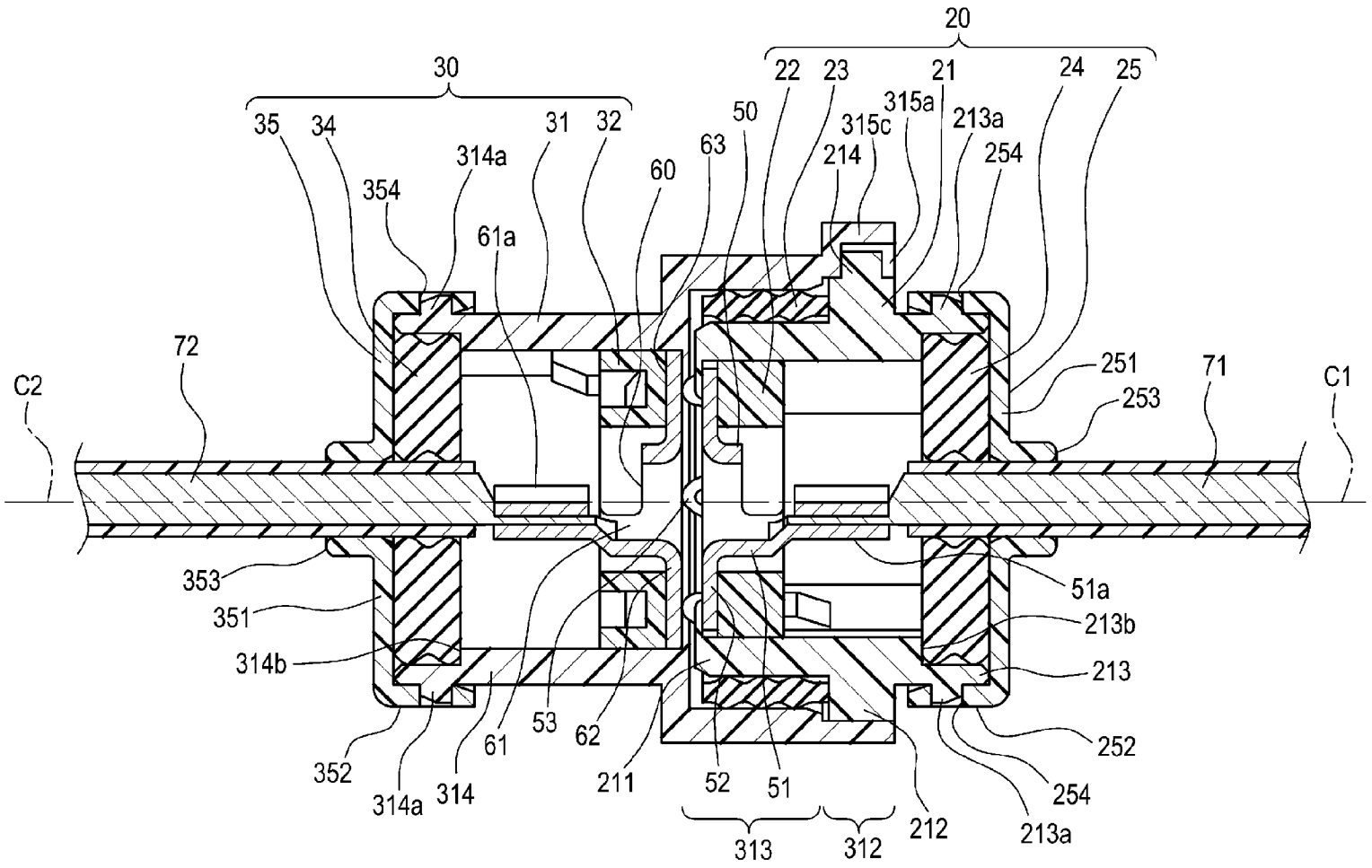
FIG. 3 is a sectional view taken along line B-B of FIG. 2.
Figure 4:
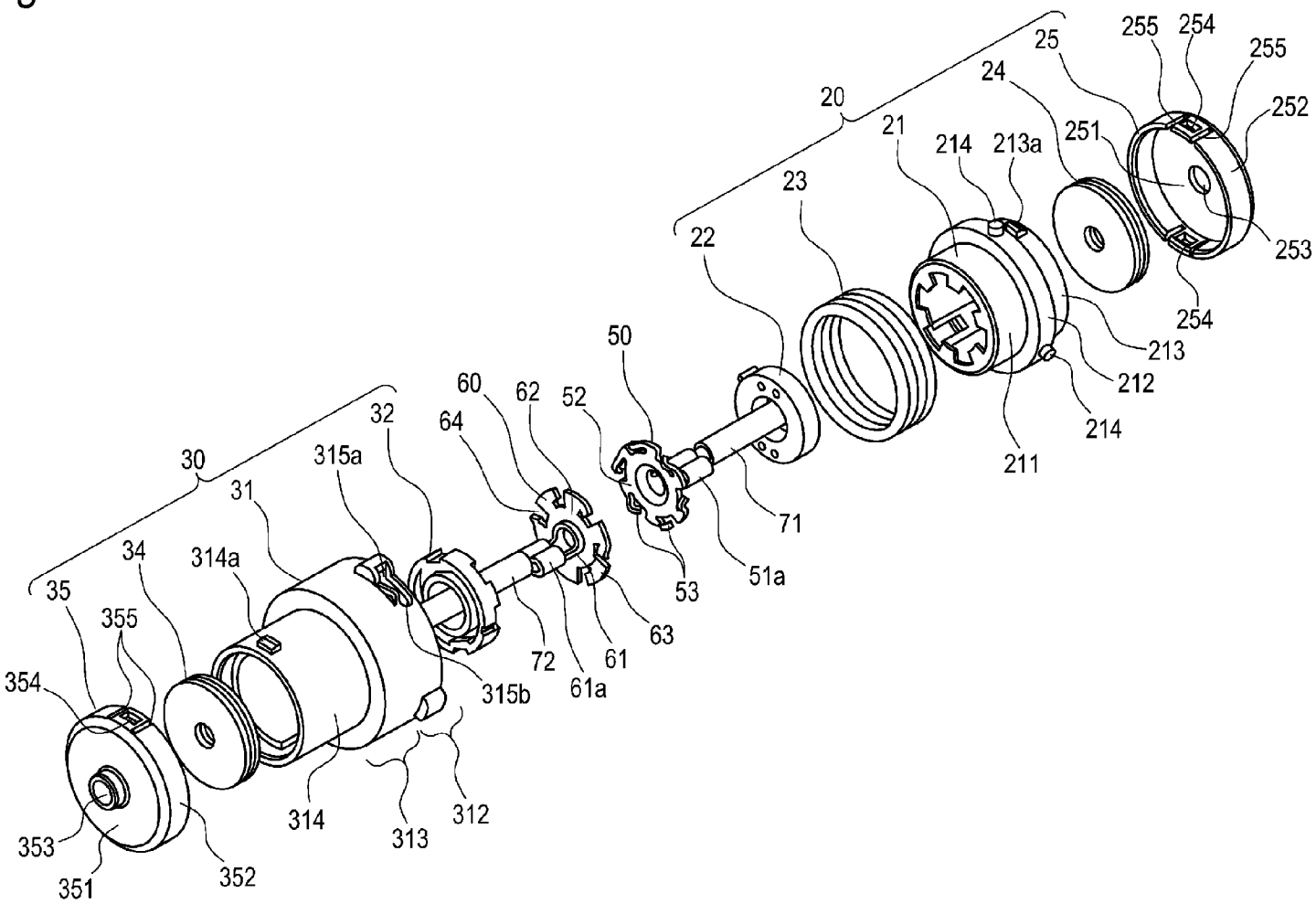
FIG. 4 is an exploded perspective view of the rotary connector of the first embodiment of the present invention.
Figure 5:
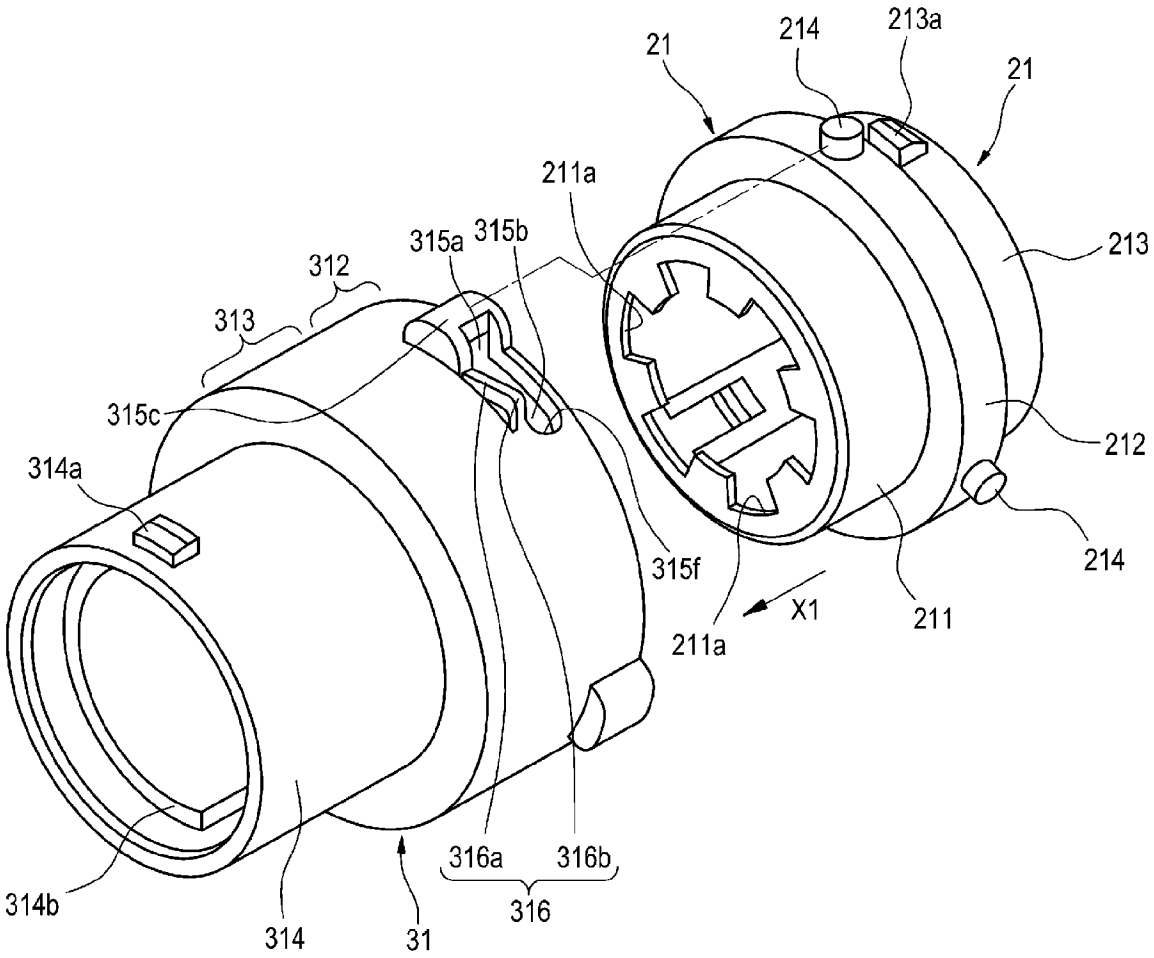
FIG. 5 is a perspective view of a state in which a first connector housing and a second connector housing of the first embodiment of the present invention face each other.
Figure 6:
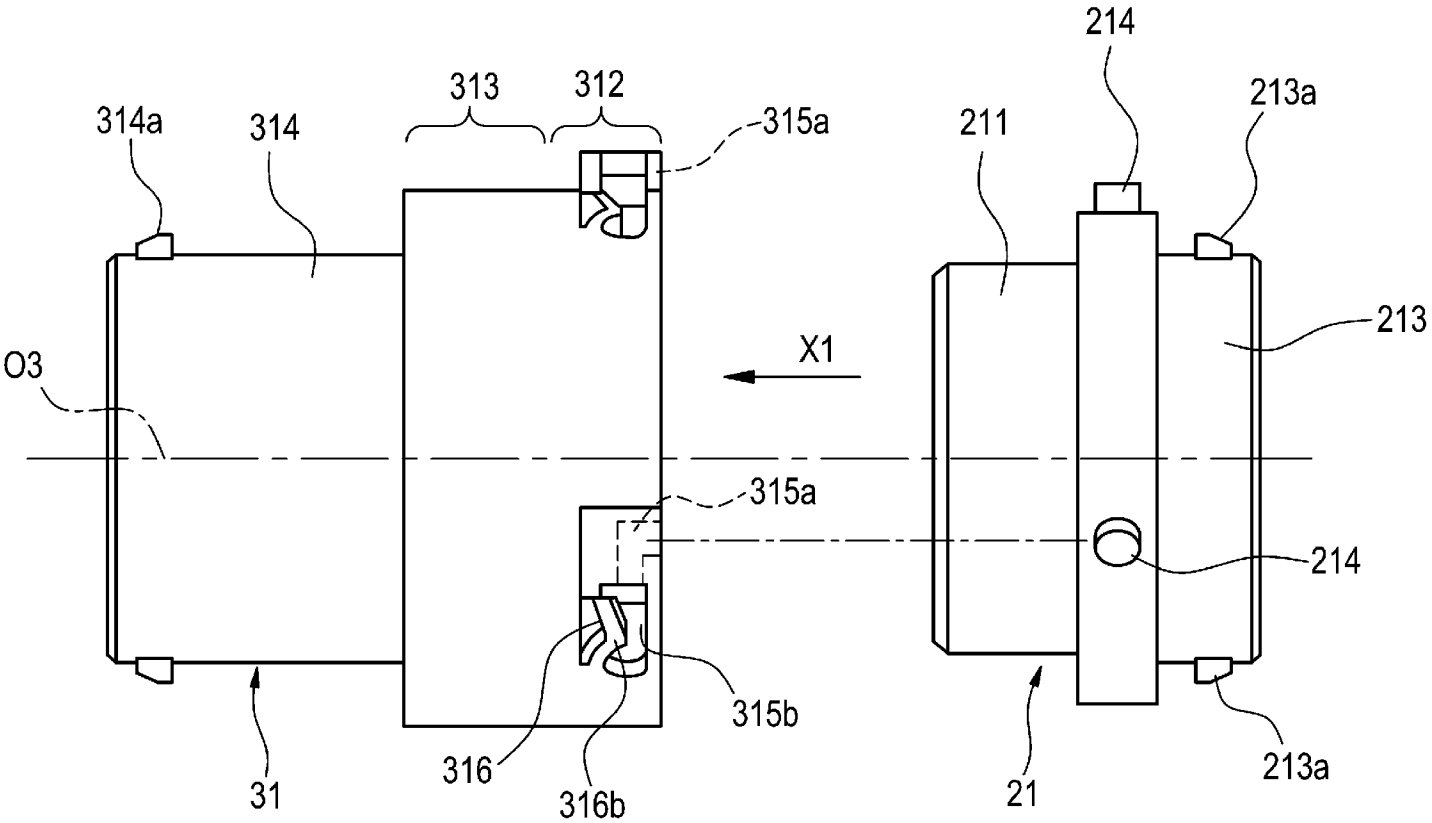
FIG. 6 is a plan view of the state in which the first connector housing and the second connector housing of the first embodiment of the present invention face each other.
Figure 7:
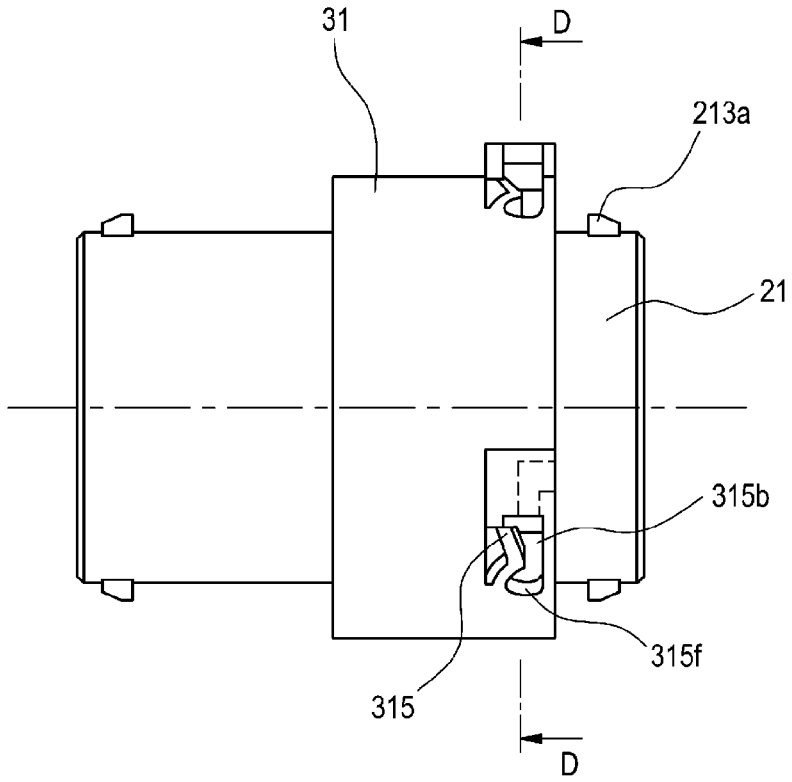
FIG. 7 is an external view of a state in which the connector housings are fitted to each other in an axial direction and a connection pin reaches the end of an axial groove of a second housing body in the first embodiment of the present invention.
Figure 8:
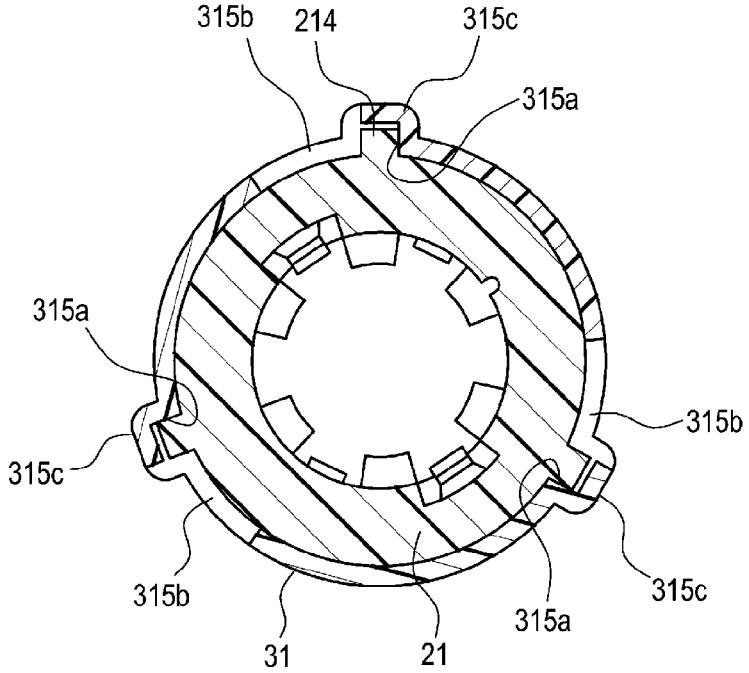
FIG. 8 is a sectional view taken along line D-D of FIG. 7.
Figure 9:
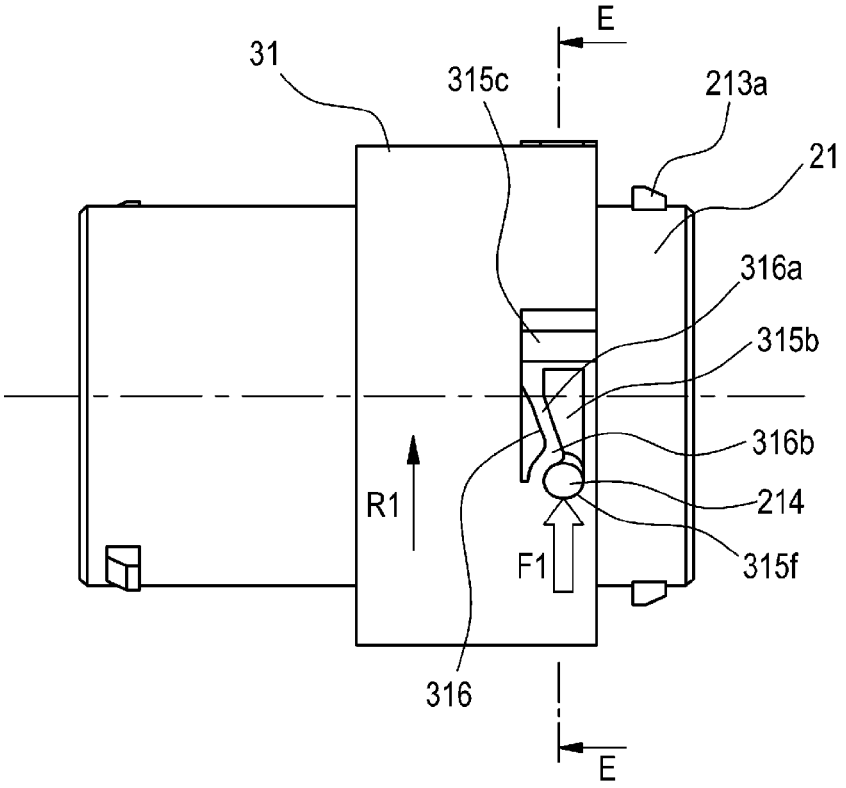
FIG. 9 is an external view of a state in which joining of the connector housings is locked in the first embodiment of the present invention.
Figure 10:
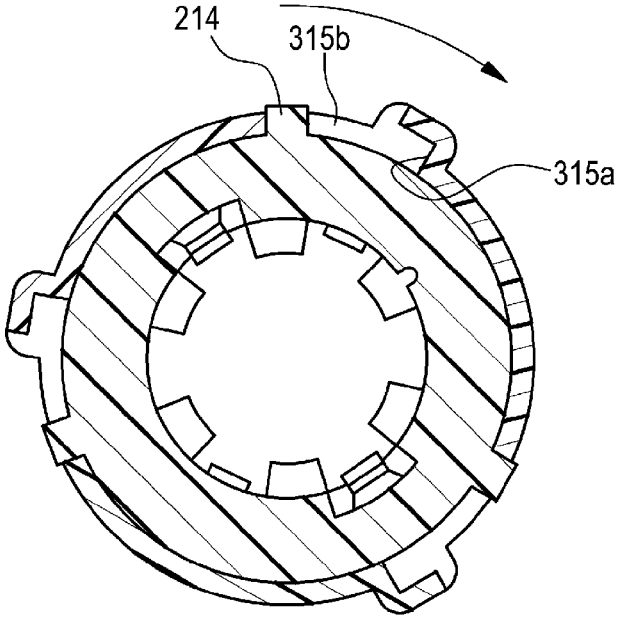
FIG. 10 is a sectional view taken along line E-E of FIG. 9.

FIGS. 1 to 10 illustrate a first embodiment of a rotary connector according to the present invention. FIG. 1 is a perspective view of an assembled state of the first embodiment of the rotary connector according to the present invention, FIG. 2 is a view viewed from arrow A of FIG. 1, FIG. 3 is a sectional view taken along line B-B of FIG. 2, FIG. 4 is an exploded perspective view of the rotary connector of the first embodiment of the present invention, FIG. 5 is a perspective view of a state in which a first connector housing and a second connector housing of the first embodiment of the present invention face each other, FIG. 6 is a plan view of the state in which the first connector housing and the second connector housing of the first embodiment of the present invention face each other, FIG. 7 is an external view of a state in which the connector housings are fitted to each other in an axial direction and a connection pin reaches the end of an axial groove of a second housing body in the first embodiment of the present invention, FIG. 8 is a sectional view taken along line D-D of FIG. 7, FIG. 9 is an external view of a state in which joining of the connector housings is locked in the first embodiment of the present invention, and FIG. 10 is a sectional view taken along line E-E of FIG. 9.

The rotary connector 10 of the first embodiment includes, as illustrated in FIGS. 1 to 5, a first connector housing 20, and a second connector housing 30 which is fitted and connected to the first connector housing 20.

As illustrated in FIGS. 3 and 4, the first connector housing 20 includes a first housing body 21 which accommodates a first terminal fitting 50 and has a substantially cylindrical shape, a front holder 22 which is fitted and attached to the inner periphery of the tip end (in FIG. 3, left end) side of the first housing body 21, an annular packing 23 which is fitted and attached to the outer periphery of the tip end side of the first housing body 21, a first rubber stopper 24 which is fitted and attached to the inner periphery of the base end (in FIG. 3, right end) side of the first housing body 21, and a rear holder 25 which covers the base end of the first housing body 21.

As illustrated in FIG. 3, the first housing body 21 includes a tip end side cylindrical portion 211 having an inner periphery to which the front holder 22 is fitted, a cylindrical barrel portion 212 which is connected to the rear end of the tip end side cylindrical portion 211 and has a greater outer diameter than that of the tip end side cylindrical portion 211, and a cylindrical base end cylindrical portion 213 which is connected to the rear end of the barrel portion 212 and has a smaller outer diameter than that of the barrel portion 212.

The transverse sectional shape of the outer periphery of any of the tip end side cylindrical portion 211, the barrel portion 212, and the base end cylindrical portion 213 is circular. In addition, the tip end side cylindrical portion 211, the barrel portion 212, and the base end cylindrical portion 213 have cylindrical shapes having a common axis. In addition, when externally viewed, the barrel portion 212 extends on the base end side of the tip end side cylindrical portion 211 in a flange shape.

As illustrated in FIG. 5, the front end surface of the tip end side cylindrical portion 211 is provided with cut-outs 211*a* which are engaged with the outer periphery of the tip end of the first terminal fitting 50 to stop the rotation of the first terminal fitting 50.

In the case of the first housing body 21 of this embodiment, connection pins 214 are provided at three points which are separated in the peripheral direction of the outer periphery of the barrel portion 212. The connection pins 214 at the three points have a columnar shape and are provided to extend outward in the radial direction of the barrel portion 212. In addition, the three points at which the connection pins 214 are provided are positions that trisect the outer periphery of the barrel portion 212.

As illustrated in FIG. 3, locking protrusions 213*a* for locking the rear holder 25 protrude from the outer periphery of the base end cylindrical portion 213 of the first housing body 21. The locking protrusions 213*a* are provided at two points of the outer periphery of the base end cylindrical portion 213.

As illustrated in FIG. 3, the front holder 22 is fitted to the inner periphery of the front end side of the tip end side cylindrical portion 211 and determines the axial position of the first terminal fitting 50. The first terminal fitting 50 is fixed on a center axis C1 of the first housing body 21 via the front holder 22 so that the tip end surface thereof is exposed from the tip end of the tip end side cylindrical portion 211. In other words, the first housing body 21 fixes and supports the first terminal fitting 50 so that the tip end portion of the first terminal fitting 50 is exposed from the front end thereof.

The packing 23 is fitted to the outer periphery of the tip end side cylindrical portion 211. The outer periphery of the packing 23 comes into close contact with the cylindrical portion of a second housing body 31 in the second connector housing 30, which will be described later such that the fitted portion of the first housing body 21 and the second housing body 31 is water-tightly sealed.

As illustrated in FIG. 3, the first rubber stopper 24 is fitted and attached to the inner periphery of the base end cylindrical portion 213 of the first housing body 21. A portion of the base end cylindrical portion 213 to which the first rubber stopper 24 is attached is provided with a stepped portion 213*b* which has a greater diameter than the inner diameter of the tip end side cylindrical portion 211 side and abuts the outer peripheral edge of the first rubber stopper 24. The first rubber stopper 24 of this embodiment water-tightly seals a gap between the outer periphery of an electric wire 71 which is drawn from the base end side of the first housing body 21 toward the outside and the inner peripheral portion of the base end side of the first housing body 21.

As illustrated in FIG. 4, the rear holder 25 includes a disk portion 251 which covers the opening of the base end cylindrical portion 213, and a cylindrical portion 252 which extends from the outer periphery of the disk portion 251 and is fitted to the outer periphery of the base end cylindrical portion 213. The center of the disk portion 251 is provided with an electric wire insertion hole 253 through which the electric wire 71 is inserted. Engagement holes 254 which are engaged with the locking protrusions 213*a* on the base end cylindrical portion 213 are formed in the cylindrical portion 252. The cylindrical portion 252 is provided with slits 255 on both sides of the engagement hole 254. The slit 255 allows a portion having the engagement hole 254 to be easily elastically deformed. The rear holder 25 mounted on the base end cylindrical portion 213 presses the first rubber stopper 24 attached to the inner periphery of the base end cylindrical portion 213 against the stepped portion 213*b* so as to fix the first rubber stopper 24.

As illustrated in FIGS. 3 and 4, the second connector housing 30 includes a second housing body 31 which accommodates a second terminal fitting 60 and has a substantially cylindrical shape, a front holder 32 which is fitted and attached to the inner periphery of the tip end (in FIG. 3, right end) side of the second housing body 31, a second rubber stopper 34 which is fitted and attached to the inner periphery of the base end (in FIG. 3, left end) side of the second housing body 31, and a rear holder 35 which covers the base end of the second housing body 31.

As illustrated in FIG. 3, the second housing body 31 includes a cylindrical portion 312 to which the barrel portion 212 of the first connector housing 20 is fitted, and intermediate cylindrical portion 313 which is connected to the rear end of the cylindrical portion 312 and has a smaller inner diameter than the outer diameter of the barrel portion 212, and a base end cylindrical portion 314 which is connected to the rear end of the intermediate cylindrical portion 313 and acts as an accommodation portion of the second terminal fitting 60.

The cylindrical portion 312 is positioned at the tip end of the second housing body 31. The cylindrical portion 312 is provided with an axial groove 315*a*, a peripheral groove 315*b*, and a locking spring piece 316 at each of the three points corresponding to the connection pins 214 provided on the barrel portion 212.

The three points on the cylindrical portion 312 at which the axial grooves 315*a* are provided are positions that trisect the outer periphery of the cylindrical portion 312.

As illustrated in FIGS. 3 and 8, the axial groove 315*a* is formed to be cut out from the cylindrical portion 312 so as to extend from the opening end of the cylindrical portion 312 along the direction of a center axis O3 (see FIG. 6) of the cylindrical portion 312. As illustrated by arrow X1 in FIGS. 5 and 6, when the barrel portion 212 is fitted to the cylindrical portion 312 along the direction of the center axis O3 of the cylindrical portion 312, the connection pin 214 on the barrel portion 212 is inserted into the axial groove 315*a*. The groove width of the axial groove 315*a* is set to be slightly greater than the outer diameter of the connection pin 214 so as to allow the connection pin 214 to smoothly move.

In addition, the center axis O3 of the cylindrical portion 312 is coincident with the center axis C2 of the second housing body 31 illustrated in FIG. 3.

As illustrated in FIGS. 6 and 8, the peripheral groove 315*b* extends from the end of the axial groove 315*a* toward one side in the peripheral direction of the cylindrical portion 312 (toward the lower side in FIG. 6 and counterclockwise in FIG. 8) along the peripheral direction. The peripheral groove 315*b* is a groove in which the connection pin 214 moves when the cylindrical portion 312 and the barrel portion 212 rotate relative to each other. The groove width of the peripheral groove 315*b* is set to be slightly greater than the outer diameter of the connection pin 214 so as to allow the connection pin 214 to smoothly move. The groove width of an end 315*f* (see FIG. 5) of the peripheral groove 315*b* is modified so as to allow the connection pin 214 that is moved to come into close contact with an arc surface of the end.

In the case of this embodiment, as illustrated in FIG. 5, a connection wall 315*c* is provided on the outside in the radial direction of the axial groove 315*a*. The connection wall 315*c* straddles the upper side of the axial groove 315*a* and is connected to the wall portions on both sides of the peripheral groove 315*b* to strengthen the periphery of the peripheral groove 315*b*.

As illustrated in FIG. 5, the locking spring piece (locking portion in the present invention) 316 includes a spring piece 316*a* which is formed integrally with the cylindrical portion 312 to extend along the peripheral groove 315*b*, and a locking protrusion 316*b* which is formed integrally with the spring piece 316*a* to protrude toward the inside of the peripheral groove 315*b*. In the case of this embodiment, the spring piece 316*a* has a plate spring shape that is bent in an approximately V shape, and the V-shaped bent portion functions as the locking protrusion 316*b*.

As illustrated in FIG. 9, when the connection pin 214 reaches the end 315*f* of the peripheral groove 315*b*, in the locking spring piece 316, the locking protrusion 316*b* elastically comes into contact with the connection pin 214 from the start side of the peripheral groove 315*b* and restricts the movement of the connection pin 214 in a return direction (arrow R1 direction of FIG. 9).

In addition, as illustrated in FIG. 9, in the locking spring piece 316 of this embodiment, in a case where the locking protrusion 316*b* receives a pressing force F1 of a predetermined magnitude or higher in a direction toward the start side of the peripheral groove 315*b* from the connection pin 214 positioned at the end 315*f* of the peripheral groove 315*b*, the locking protrusion 316*b* retreats from the peripheral groove 315*b* and allows the movement of the connection pin 214 toward the start side of the peripheral groove 315*b*. That is, in the case of this embodiment, when a rotating operation force is applied to the second housing body 31 or the first housing body 21 so as to cause the connection pin 214 to return to the start side of the peripheral groove 315*b* in a state where joining of the second housing body 31 and the first housing body 21 is locked, if the rotating operation force reaches a predetermined magnitude or higher, the locking spring piece 316 retreats toward the outside of the peripheral groove 315*b* so as to enable the connection pin 214 to move toward the start side of the peripheral groove 315*b*.

As illustrated in FIG. 3, the intermediate cylindrical portion 313 in the second housing body 31 is a cylindrical portion which accommodates the tip end side cylindrical portion 211 of the first housing body 21. The inner diameter of the intermediate cylindrical portion 313 is set so as to allow the packing 23 to be interposed between the intermediate cylindrical portion 313 and the tip end side cylindrical portion 211. The inner periphery of the packing 23 that is interposed between the intermediate cylindrical portion 313 and the tip end side cylindrical portion 211 comes into close contact with the tip end side cylindrical portion 211 and the outer periphery thereof comes into close contact with the intermediate cylindrical portion 313 such that the fitted portion of the first housing body 21 and the second housing body 31 is water-tightly sealed.

As illustrated in FIG. 3, the inner diameter of the base end cylindrical portion 314 in the second housing body 31 is set to be smaller than that of the intermediate cylindrical portion 313. The base end cylindrical portion 314 accommodates the second terminal fitting 60 and allows the front holder 32 which regulates the axial position of the second terminal fitting 60 to be fitted and attached to the base end cylindrical portion 314. The base end cylindrical portion 314 fixes and supports the second terminal fitting 60 on the center axis C2 of the second housing body 31 via the front holder 32. In addition, the base end cylindrical portion 314 supports the second terminal fitting 60 so that the tip end portion of the second terminal fitting 60 is exposed from the front end of the second housing body 31.

As illustrated in FIG. 3, locking protrusions 314*a* for locking the rear holder 35 protrude from the outer periphery of the base end of the base end cylindrical portion 314. The locking protrusions 314*a* are provided at two points of the outer periphery of the base end cylindrical portion 314.

As illustrated in FIG. 3, the second rubber stopper 34 is fitted and attached to the inner periphery of the base end of the base end cylindrical portion 314. A portion of the base end cylindrical portion 314 to which the second rubber stopper 34 is attached is provided with a stepped portion 314*b* which has a greater diameter than the inner diameter of the front holder 32 side and abuts the outer peripheral edge of the second rubber stopper 34.

The second rubber stopper 34 of this embodiment water-tightly seals a gap between the outer periphery of an electric wire 72 which is drawn from the base end side of the second housing body 31 toward the outside and the inner peripheral portion of the base end side of the second housing body 31.

As illustrated in FIG. 4, the rear holder 35 includes a disk portion 351 which covers the opening of the base end cylindrical portion 314, and a cylindrical portion 352 which extends from the outer periphery of the disk portion 351 and is fitted to the outer periphery of the base end cylindrical portion 314. The center of the disk portion 351 is provided with an electric wire insertion hole 353 through which the electric wire 72 is inserted. Engagement holes 354 which are engaged with the locking protrusions 314*a* on the base end cylindrical portion 314 are formed in the cylindrical portion 352. The cylindrical portion 352 is provided with slits 355 on both sides of the engagement hole 354. The slit 355 allows a portion having the engagement hole 354 to be easily elastically deformed. As illustrated in FIG. 3, the rear holder 35 mounted on the base end cylindrical portion 314 presses the second rubber stopper 34 attached to the inner periphery of the base end cylindrical portion 314 against the stepped portion 313*b* so as to fix the second rubber stopper 34.

Next, a procedure of fitting and connecting the first connector housing 20 and the second connector housing 30 to each other in the rotary connector 10 of the first embodiment described above will be described with reference to FIGS. 5 to 10.

First, as illustrated in FIGS. 5 and 6, the first connector housing 20 and the second connector housing 30 are in a state of facing each other so that the positions of a plurality of connection pins 214 of the barrel portion 212 of the first housing body 21 are aligned with the positions of a plurality of axial grooves 315*a* of the cylindrical portion 312 of the second housing body 31. Thereafter, as indicated by arrow X1 in FIG. 6, the second housing body 31 and the first housing body 21 are allowed to abut each other along the direction of the center axis O3 of the cylindrical portion 312 of the second housing body 31 such that a fitted state illustrated in FIGS. 7 and 8 is obtained. The fitted state illustrated in FIGS. 7 and 8 is a state in which each of the connection pins 214 reaches the end of the corresponding axial groove 315*a*.

Next, when the housing bodies 21 and 31 are rotated relative to each other to allow the connection pins 214 on the first housing body 21 to intrude into the respective peripheral grooves 315*b* on the second housing body 31, the relative movement of the housing bodies 21 and 31 in the axial direction is restricted and thus the connector housings 20 and 30 enter a joined state.

When the housing bodies 21 and 31 are further rotated relative to each other until each of the connection pins 214 reaches the end 315*f* of the corresponding peripheral groove 315*b*, as illustrated in FIGS. 9 and 10, the locking protrusion 316*b* of the locking spring piece 316 elastically comes into contact with the connection pin 214 from the start side of the peripheral groove 315*b* and restricts the movement of the connection pin 214 in the return direction, such that the joined state of the connector housings 20 and 30 is locked.

In addition, in the rotary connector 10 of this embodiment, as illustrated in FIGS. 9 and 10, in a state where the joined state of the housing bodies 21 and 31 is locked, a rotating operation force is applied to the housing bodies in the direction opposite to that during the locked state so as to allow the connection pin 214 to apply a pressing force of a predetermined magnitude or higher to the locking protrusion 316*b* of the locking spring piece 316 in a direction toward the start side of the peripheral groove 315*b*, the locking protrusion 316*b* retreats from the peripheral groove 315*b* and enters a lock released state, thereby enabling the connection pin 214 to move toward the start side of the peripheral groove 315*b*.

Therefore, after the housing bodies are rotated until the connection pin 214 reaches the start of the peripheral groove 315*b* (that is, the end of the axial groove 315*a*), the housing bodies are separated from each other in the axial direction, thereby allowing the connector housings 20 and 30 to be in a state of being separated from each other.

That is, in the rotary connector 10 of this embodiment, without using a tool, the connector housings 20 and 30 can be simply attached to and detached from each other only by a moving operation in the axial direction and a rotating operation in the peripheral direction.

Figure 13:
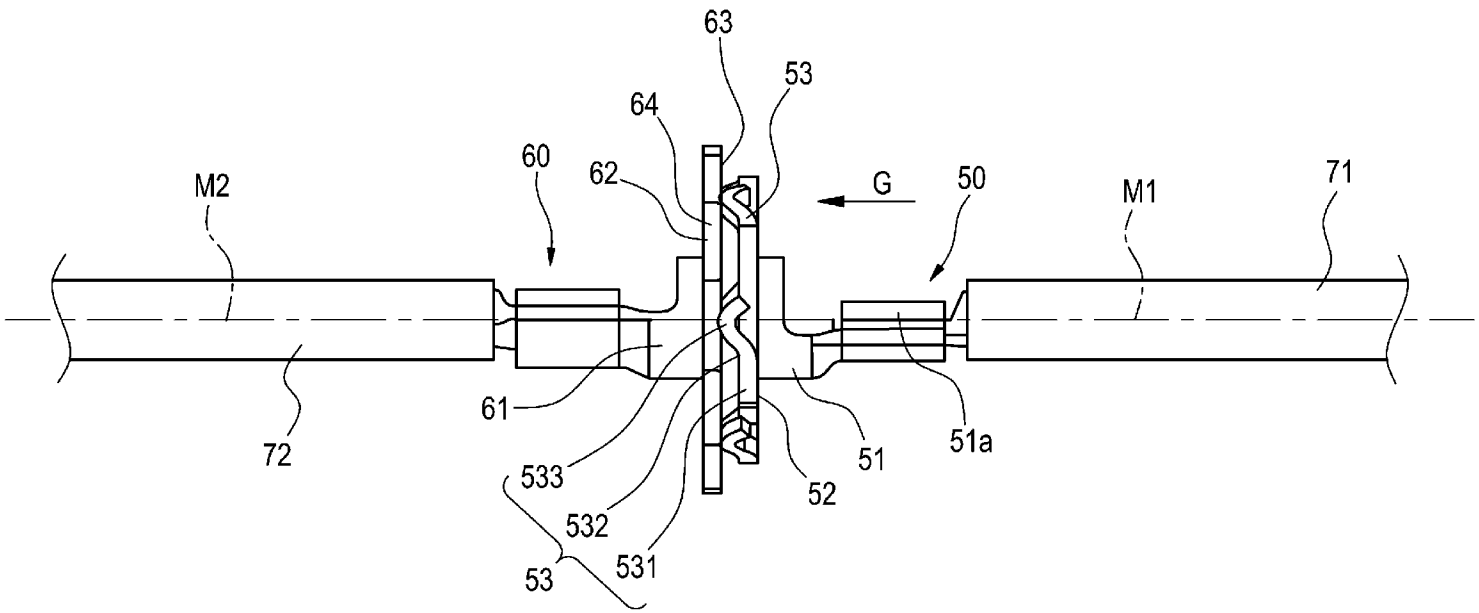
FIG. 13 is a side view of a state in which the first terminal fitting and the second terminal fitting abut each other in the first embodiment.
Figure 14:
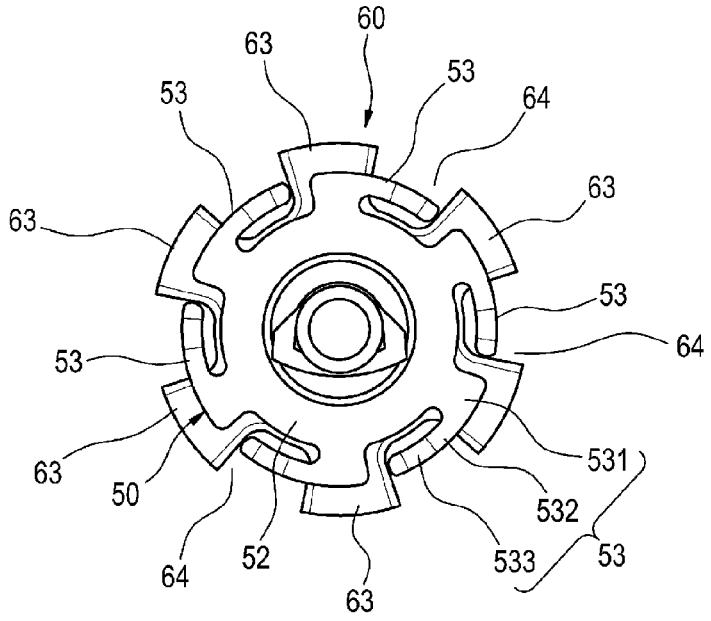
FIG. 14 is a view viewed from arrow G of FIG. 13.

In addition, when the housing bodies 21 and 31 are in the fitted state illustrated in FIGS. 7 and 8, in the first terminal fitting 50 and the second terminal fitting 60 which are respectively fixed and supported by the housing bodies 21 and 31, as illustrated in FIGS. 13 and 14, which will be described later, the tip end portions thereof abut each other in a state where a contact spring piece 53 provided in the first terminal fitting 50 is inserted into a contact release portion 64 provided in the second terminal fitting 60.

Figure 15:
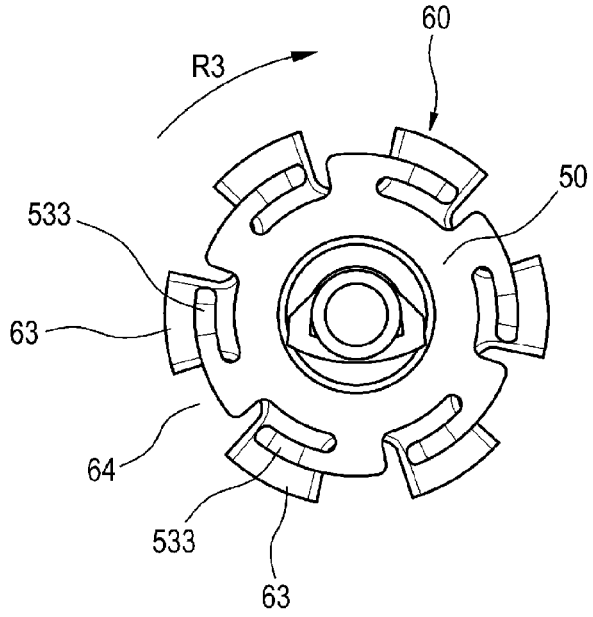
FIG. 15 is an explanatory view of a state in which the second terminal fitting is rotated relative to the first terminal fitting by a predetermined angle in arrow R3 direction from the state of FIG. 14 and a contact protrusion of the first terminal fitting rides on a contact surface of the second terminal fitting.
Figure 16:
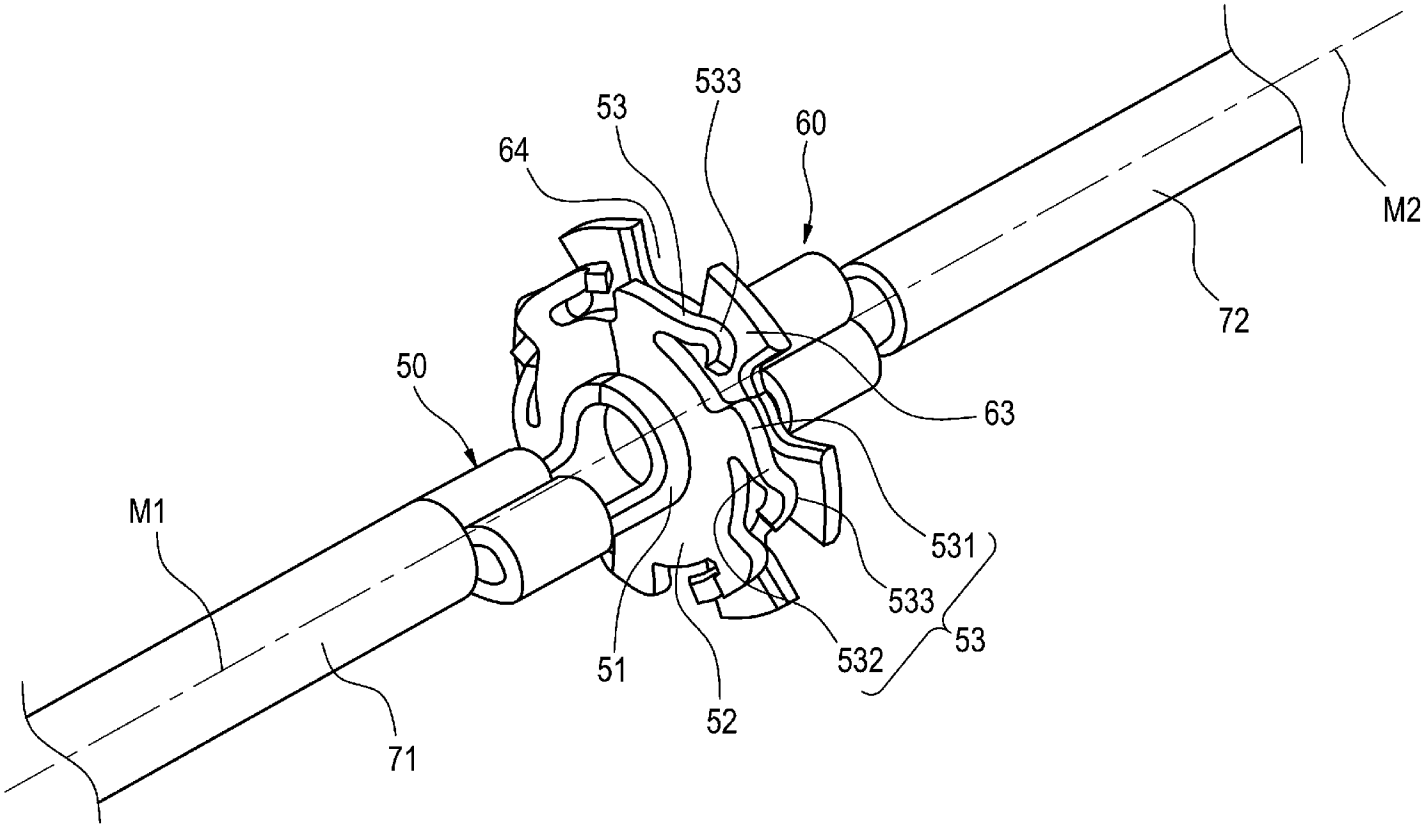
FIG. 16 is a perspective view of the first terminal fitting and the second terminal fitting in a connected state illustrated in FIG. 15.

In addition, when the housing bodies 21 and 31 are in the locked state illustrated in FIGS. 9 and 10, in the first terminal fitting 50 and the second terminal fitting 60 which are respectively fixed and supported by the housing bodies 21 and 31, as illustrated in FIGS. 15 and 16, which will be described later, the contact spring piece 53 provided in the first terminal fitting 50 rides on a contact surface 63 provided in the second terminal fitting 60 such that the first terminal fitting 50 and the second terminal fitting 60 enter a state of being electrically connected to each other.

Description of Terminal Fitting Connection Structure of First Embodiment

Figure 11:
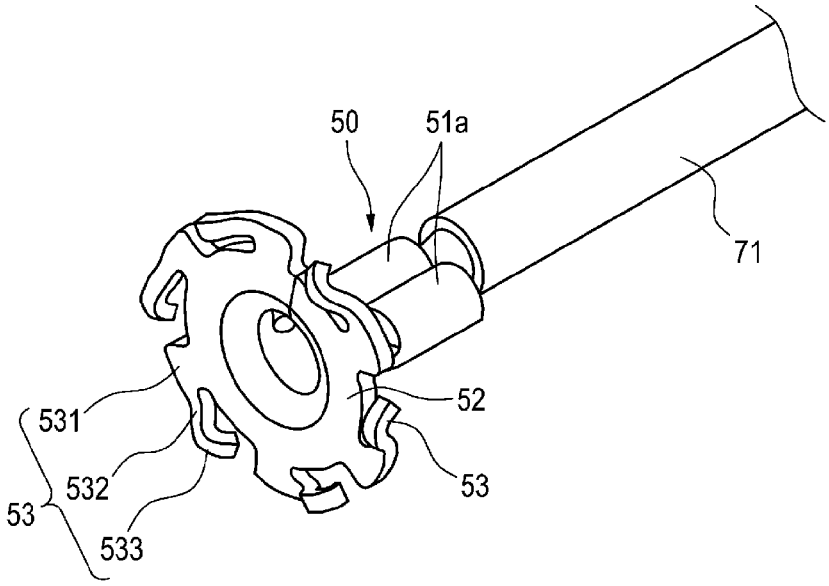
FIG. 11 is an enlarged view of a first terminal fitting illustrated in FIG. 4.
Figure 12:
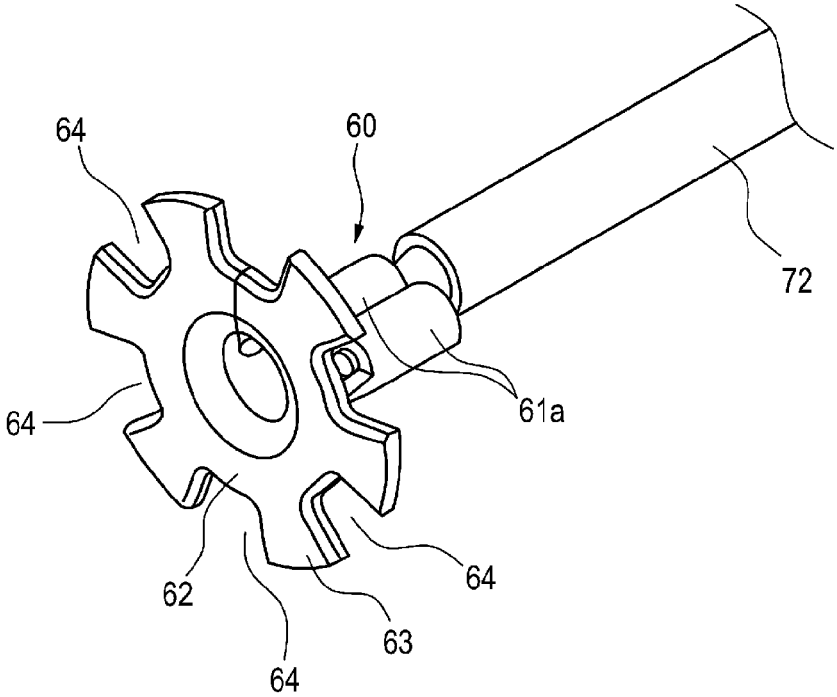
FIG. 12 is an enlarged view of a second terminal fitting illustrated in FIG. 4.

FIGS. 11 to 16 illustrate the terminal fitting connection structure of the first embodiment. FIG. 11 is an enlarged view of the first terminal fitting illustrated in FIG. 4, FIG. 12 is an enlarged view of the second terminal fitting illustrated in FIG. 4, FIG. 13 is a side view of a state in which the first terminal fitting and the second terminal fitting abut each other in the first embodiment, FIG. 14 is a view viewed from arrow G of FIG. 13, and FIG. 15 is an explanatory view of a state in which the second terminal fitting is rotated relative to the first terminal fitting by a predetermined angle in arrow R3 direction from the state of FIG. 14 and a contact protrusion of the first terminal fitting rides on the contact surface of the second terminal fitting.

In the terminal fitting connection structure of the first embodiment, the contact spring piece 53 provided in the first terminal fitting 50 comes into pressing contact with the contact surface 63 provided in the second terminal fitting 60 such that the first terminal fitting 50 and the second terminal fitting 60 enter a state of being electrically connected to each other.

The first terminal fitting 50 is an abutting type terminal fitting in which the tip end thereof is allowed to abut the tip end of a mated terminal fitting and is thus electrically connected to the mated terminal fitting. The first terminal fitting 50 is a press-formed product of a metal plate and as illustrated in FIG. 13, includes a first terminal body 51, a first annular portion 52, and a plurality of contact spring pieces 53.

As illustrated in FIG. 13, the first terminal body 51 extends on a center axis M1 of the first terminal fitting 50. The base end of the first terminal body 51 (in FIG. 13, right end) is provided with a wire caulking piece 51*a*. By the wire caulking piece 51 a, the electric wire 71 is clamped and connected to the base end of the first terminal body 51 substantially coaxially with the center axis M1 of the first terminal fitting 50.

The first annular portion 52 is formed at the tip end of the first terminal body 51 (in FIG. 13, left end) in an annular shape concentrically with the center axis M1 of the first terminal fitting 50.

As illustrated in FIG. 14, the contact spring pieces 53 are provided at a plurality of points arranged on the outer periphery of the first annular portion 52 at predetermined intervals in the peripheral direction of the first annular portion 52. As illustrated in FIG. 14, the contact spring pieces 53 includes a spring support portion 531 which extends outward in the radial direction of the first annular portion 52 from the outer periphery of the first annular portion 52, an elastic piece 532 which extends from the spring support portion 531 along the outer periphery of the first annular portion 52, and a contact protrusion 533 which protrudes from the elastic piece 532.

In addition, the first annular portion 52 may have an annular portion provided with the contact spring pieces 53, and may also be hollow or solid.

The tip end side of the elastic piece 532 can be displaced in the direction of the center axis M1 of the first terminal fitting 50.

As illustrated in FIG. 13, the contact protrusion 533 protrudes from the elastic piece 532 in a state of protruding further toward a mated terminal side than the tip end of the first annular portion 52.

The second terminal fitting 60 is an abutting type terminal fitting in which the tip end thereof is allowed to abut the tip end of the first terminal fitting 50 and is thus electrically connected to the first terminal fitting 50. The second terminal fitting 60 is a press-formed product of a metal plate and as illustrated in FIG. 13, includes a second terminal body 61, a second annular portion 62, a plurality of contact surfaces 63, and a plurality of contact release portions 64.

As illustrated in FIG. 13, the second terminal body 61 extends on a center axis M2 of the second terminal fitting 60. The base end of the second terminal body 61 (in FIG. 13, left end) is provided with a wire caulking piece 61*a*. By the wire caulking piece 61*a*, the electric wire 72 is clamped and connected to the base end of the second terminal body 61 substantially coaxially with the center axis M2 of the second terminal fitting 60.

The second annular portion 62 has an annular shape with the same dimensions as those of the first annular portion 52 of the first terminal fitting 50. The second annular portion 62 is provided at the tip end of the second terminal body 61 concentrically with the center axis M2 of the second terminal fitting 60.

The contact surfaces 63 protrude outward in the radial direction of the second annular portion 62 from a plurality of points of the outer periphery of the second annular portion 62. The plurality of contact surfaces 63 are arranged on the outer periphery of the second annular portion 62 at the same intervals as those of the plurality of contact protrusions 533 in the first terminal fitting 50.

The second annular portion 62 may have an annular portion provided with the contact surfaces 63, and may also be hollow or solid.

As illustrated in FIG. 12, the contact release portions 64 are voids positioned between the adjacent contact surfaces 63. Into the contact release portions 64, the contact protrusions 533 can be inserted.

In the terminal fitting connection structure in this embodiment, the first terminal fitting 50 and the second terminal fitting 60 are allowed to face each other so as to enable the contact protrusions 533 of the plurality of contact spring pieces 53 of the first terminal fitting 50 and the plurality of contact release portions 64 of the second terminal fitting 60 to oppose each other. Next, as illustrated in FIGS. 13 and 14, the first terminal fitting 50 and the second terminal fitting 60 are allowed to abut each other on the same axis so as to allow the plurality of contact protrusions 533 of the first terminal fitting 50 to be inserted into the plurality of contact release portions 64 of the second terminal fitting 60. Thereafter, in the state in which the two terminal fittings abut each other, as illustrated in FIGS. 15 and 16, when the first terminal fitting 50 and the second terminal fitting 60 are rotated relative to each other by a predetermined angle on the same axis, the contact protrusions 533 of the plurality of contact spring pieces 53 of the first terminal fitting 50 ride on the plurality of contact surfaces 63 of the second terminal fitting 60. Accordingly, the contact protrusions 533 of the plurality of contact spring pieces 53 of the first terminal fitting 50 enter a state of coming into pressing contact with the plurality of contact surfaces 63 of the second terminal fitting 60, and thus the first terminal fitting 50 and the second terminal fitting 60 enter the electrically connected state.

In addition, in the case of the terminal fitting connection structure of this embodiment, the contact spring pieces 53 extend in the peripheral direction of the first annular portion 52 at the tip end of the first terminal fitting 50. That is, the contact spring piece 53 is configured to extend in an arc shape on a plane perpendicular to the axial direction of the first terminal fitting 50. Therefore, even when a sufficient length for the contact spring piece 53 is ensured in order to ensure stable flexibility for the contact spring piece 53, the dimensions of the terminal fittings in the axial direction are not affected.

Therefore, even in a case where a necessary and sufficient length for the contact spring piece 53 is ensured, the axial length of the terminal fittings is reduced, resulting in a reduction in the size of the terminal fittings. In addition, due to a reduction in the size of the terminal fittings, a reduction in the size of a connector that accommodates the terminal fittings can be achieved.

In addition, according to the terminal fitting connection structure in this embodiment, the electrical connection between the first terminal fitting 50 and the second terminal fitting 60 is achieved by contact between the plurality of contact protrusions 533 and the plurality of contact surfaces 63, and thus the total contact area of the contact portions of the terminal fittings is increased. Therefore, the conductor resistance in the contact portions is decreased, and thus the reliability of the electrical connection can be enhanced.

In addition, in the case of the rotary connector 10 in this embodiment, the axial lengths of the first terminal fitting 50 and the second terminal fitting 60, which are respectively accommodated in the connector housings 20 and 30, can be reduced as described above. Therefore, as the axial lengths of the terminal fittings 50 and 60 are reduced, the axial lengths of the connector housings 20 and 30 can also be reduced. Accordingly, a reduction in the size of the rotary connector 10 is achieved, and thus a mountable ability thereof in a vehicle that is difficult to ensure a sufficient installation space can be enhanced.

In addition, in the case of the rotary connector 10 in this embodiment, as illustrated in FIG. 3, the terminal fittings 50 and 60 which are respectively accommodated in the connector housings 20 and 30 are respectively fixed on the center axes C1 and C2 of the connector housings 20 and 30. Therefore, the axial movement of the connector housings 20 and 30 and the rotating operation of the connector housings 20 and 30 around the center axes C1 and C2 become the axial movement and the rotating operation of the terminal fittings 50 and 60 which are respectively accommodated in the connector housings 20 and 30.

On the other hand, moving two in an axial direction from a state in which the two face each other on the same axis so as to allow the two to abut each other, and then rotating the two that abut each other relative to each other by a predetermined angle are common to both a necessary operation for joining the connector housings 20 and 30 included in the rotary connector 10 and a necessary operation for electrically connecting the terminal fittings 50 and 60 to each other.

Therefore, by allowing a necessary relative rotation angle for a transition of the connector housings 20 and 30 from the abutting state to a lock completed state to be the same as a necessary relative rotation angle for a transition from an abutting state in which the contact protrusions 533 of the first terminal fitting 50 are inserted into the contact release portions 64 of the second terminal fitting 60 to the electrically connected state in which the contact protrusions 533 of the first terminal fitting 50 ride on the contact surfaces 63 of the second terminal fitting 60, when the joining of the connector housings 20 and 30 is locked, the terminal fittings 50 and 60 which are respectively accommodated in the connector housings 20 and 30 simultaneously can be allowed to enter the electrically connected state.

Description of Terminal Fitting Connection Structure of Second Embodiment

Figure 17:
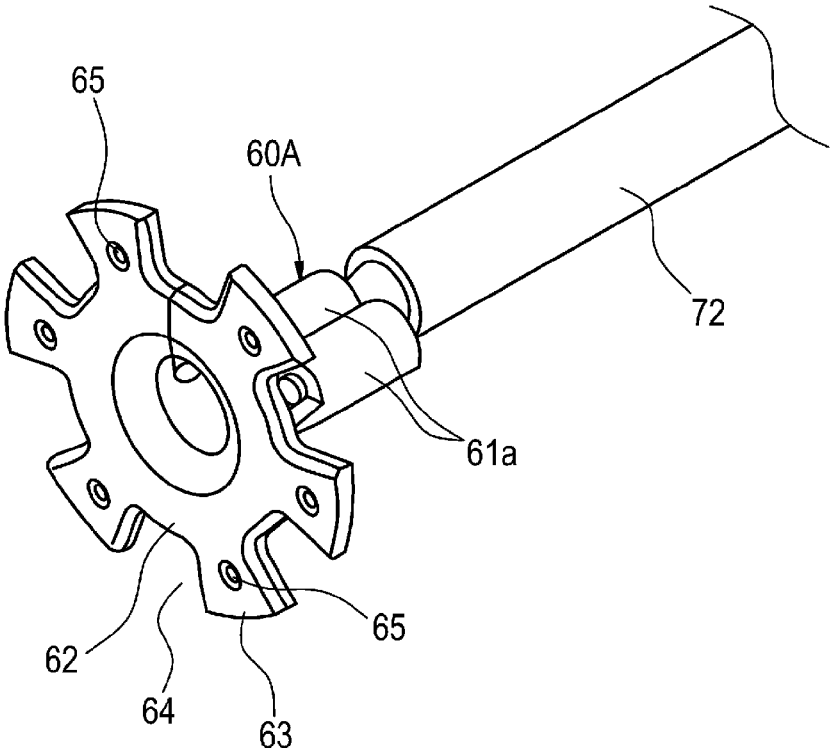
FIG. 17 is a perspective view of a second embodiment of the second terminal fitting according to the present invention.
Figure 18:
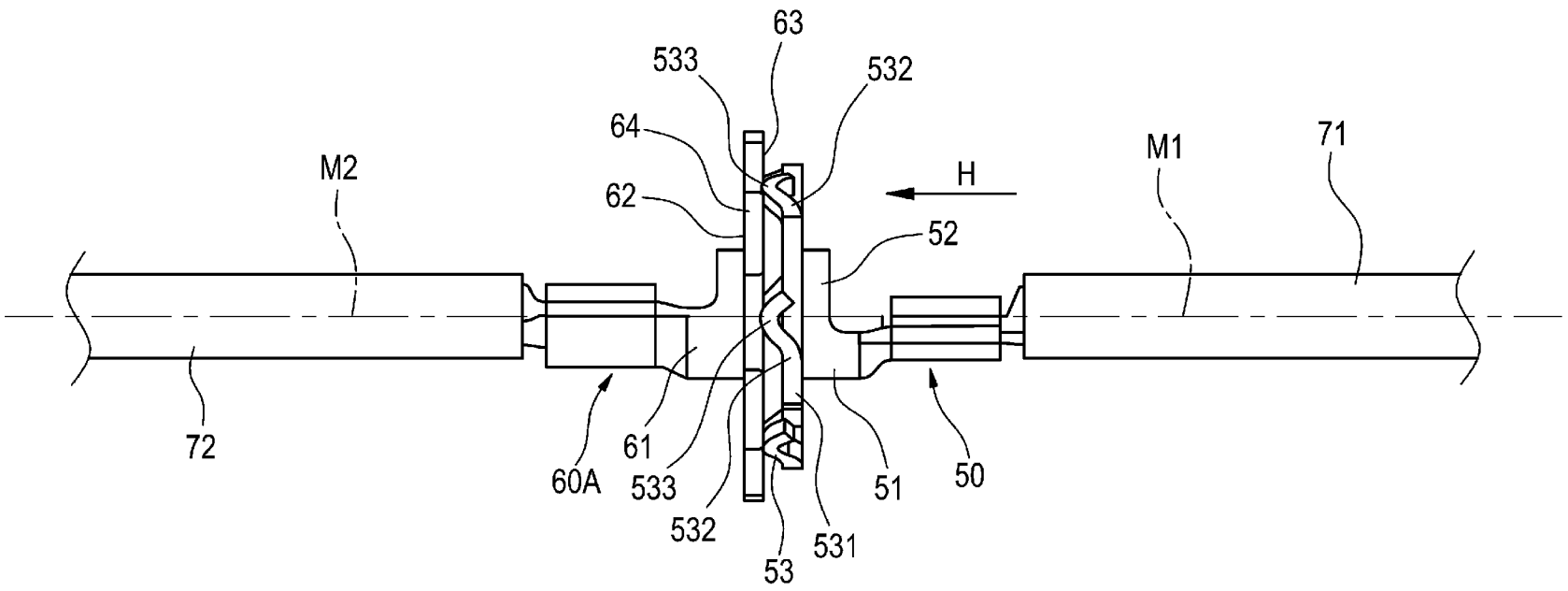
FIG. 18 is a side view of a state in which the second terminal fitting illustrated in FIG. 17 and the first terminal fitting illustrated in FIG. 11 abut each other.
Figure 19:
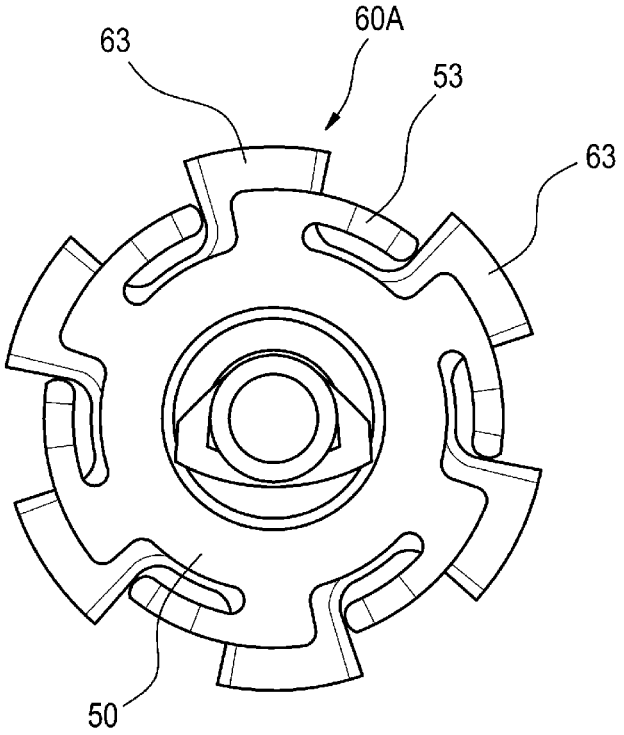
FIG. 19 is a view viewed from arrow H of FIG. 18.
Figure 20:
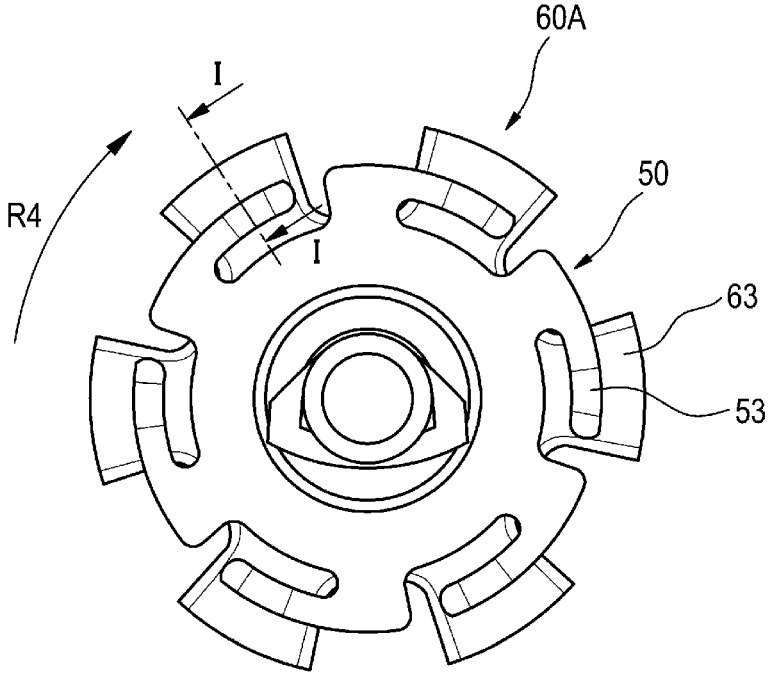
FIG. 20 is an explanatory view of a state in which the second terminal fitting is rotated relative to the first terminal fitting by a predetermined angle in arrow R4 direction from the state of FIG. 19 and the contact protrusion of the first terminal fitting rides on the contact surface of the second terminal fitting.
Figure 21:
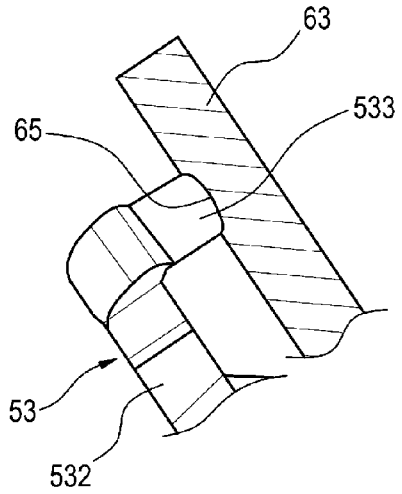
FIG. 21 is a partial sectional view taken along line I-1 of FIG. 20.
Figure 22:
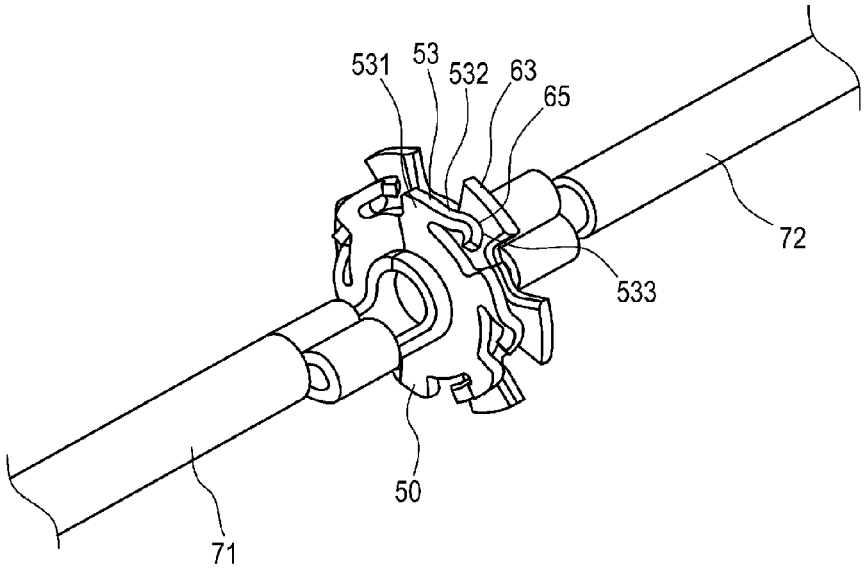
FIG. 22 is a perspective view of the first terminal fitting and the second terminal fitting in a connected state illustrated in FIG. 20.

FIGS. 17 to 22 illustrate a terminal fitting connection structure of a second embodiment. FIG. 17 is a perspective view of a second embodiment of the second terminal fitting according to the present invention, FIG. 18 is a side view of a state in which the second terminal fitting illustrated in FIG. 17 and the first terminal fitting illustrated in FIG. 11 abut each other, FIG. 19 is a view viewed from arrow H of FIG. 18, and FIG. 20 is an explanatory view of a state in which the second terminal fitting is rotated relative to the first terminal fitting by a predetermined angle in arrow R4 direction from the state of FIG. 19 and the contact protrusion of the first terminal fitting rides on a contact surface of the second terminal fitting. In addition, FIG. 21 is a partial sectional view taken along line I-I of FIG. 20, and FIG. 22 is a perspective view of the first terminal fitting and the second terminal fitting in a connected state illustrated in FIG. 20.

In the terminal fitting connection structure of the second embodiment, a second terminal fitting 60A is used instead of the second terminal fitting 60 of the first embodiment.

The second terminal fitting 60A is provided with recessed portions 65 in the plurality of contact surfaces 63 that protrude outward in the radial direction from the outer periphery of the second annular portion 62. The recessed portion 65 is a dent to which the contact protrusion 533 of the first terminal fitting 50 that rides on the contact surface 63 is fitted. The recessed portion 65 restricts the movement of the contact protrusion 533 as the contact protrusion 533 is fitted to the recessed portion 65.

The configuration of the second terminal fitting 60 of the first embodiment is common to that of the second terminal fitting 60A of the second embodiment except that the recessed portions 65 are respectively provided in the contact surfaces 63. Like elements that are common to the second terminal fitting 60 of the first embodiment are denoted by like reference numerals, and descriptions thereof will not be repeated.

In the case of the terminal fitting connection structure of the second embodiment, as illustrated in FIG. 21, the contact protrusion 533 that rides on the contact surface 63 is fitted to the recessed portion 65 provided in the contact surface 63 such that the recessed portion 65 restricts the movement of the contact protrusion 533.

Therefore, slipping of the contact protrusion 533 on the contact surface 63 due to external vibration transmitted from the electric wires 71 and 72 and the like connected to the terminal fittings 50 and 60A can be prevented. As a result, the occurrence of problems such as wear or a reduction in contact pressure caused by the slipping of the contact protrusion 533 on the contact surface 63 can be prevented.

Description of Terminal Fitting Connection Structure of Third Embodiment

Figure 23:
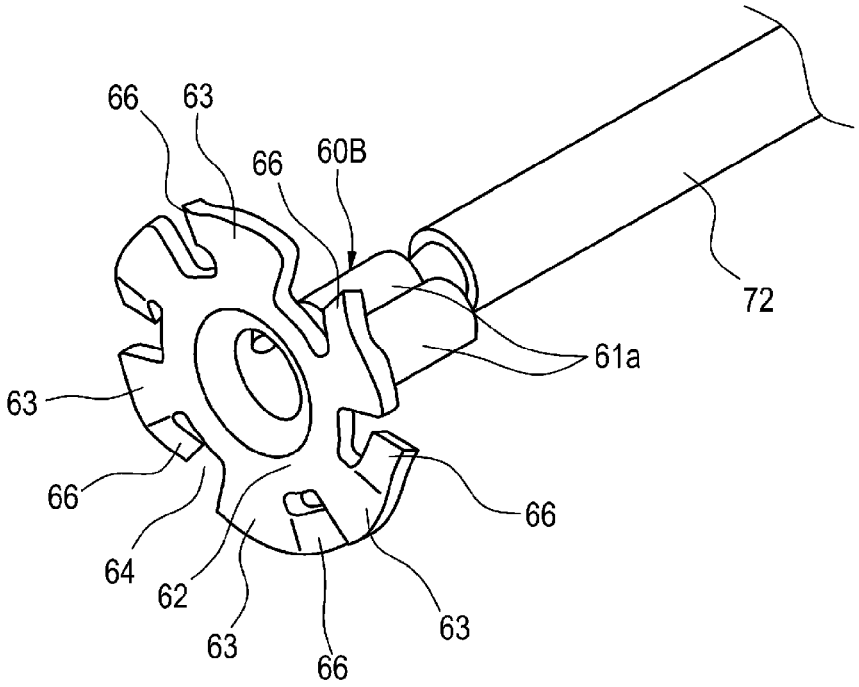
FIG. 23 is a perspective view of a third embodiment of the second terminal fitting according to the present invention.
Figure 24:
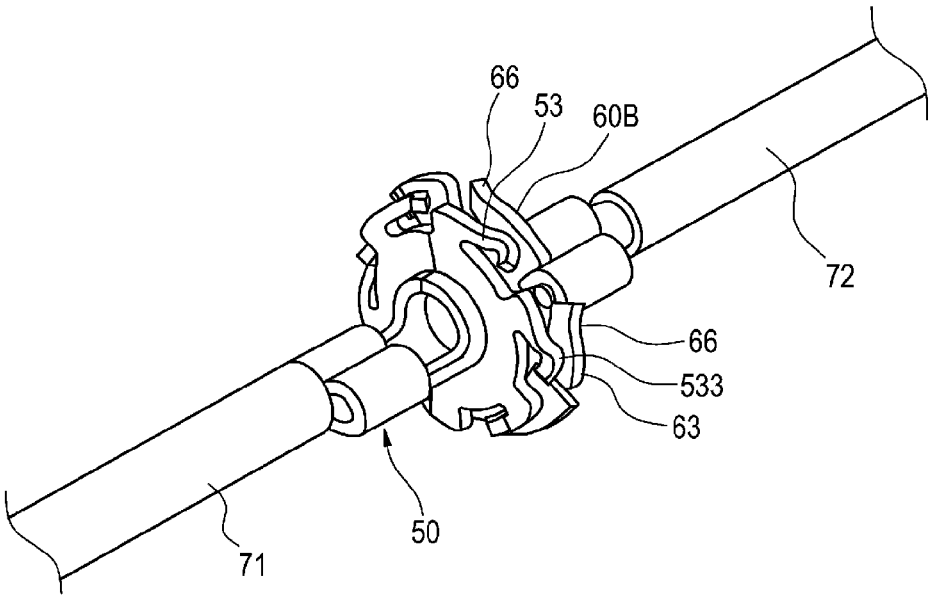
FIG. 24 is a side view of a state in which the second terminal fitting illustrated in FIG. 23 and the first terminal fitting illustrated in FIG. 11 abut each other.
Figure 25A:
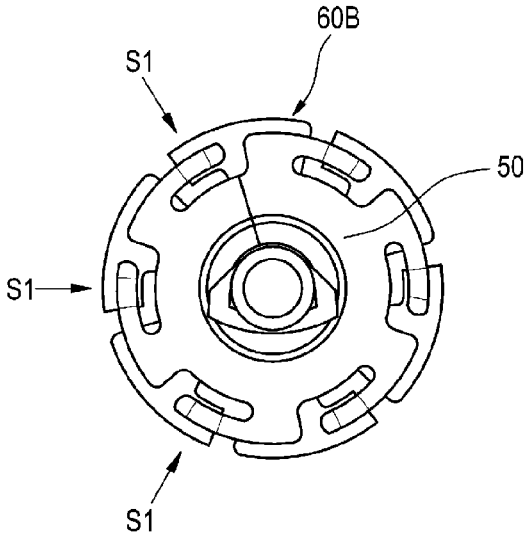
Figure 25B:
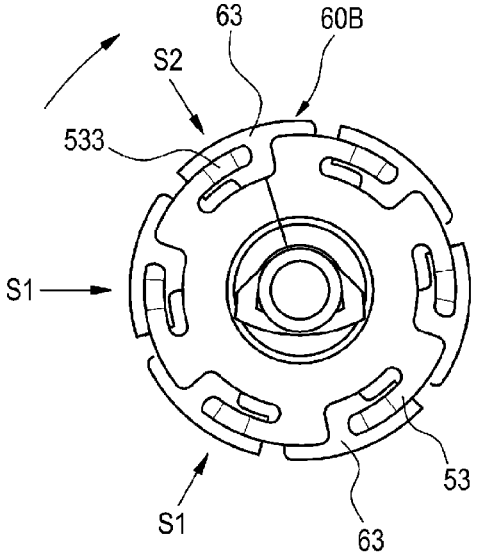
Figure 25C:
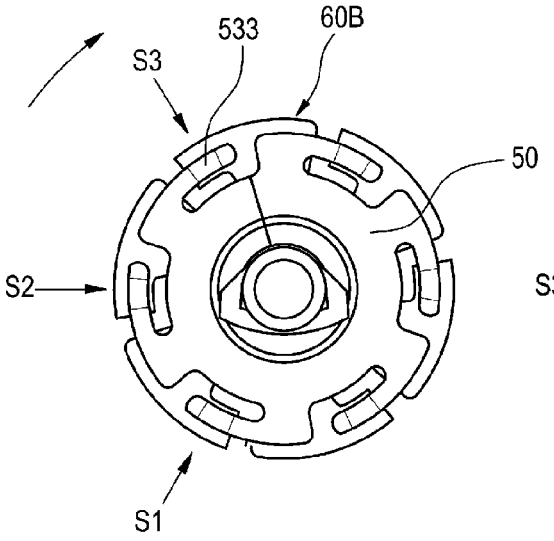
Figure 25D:
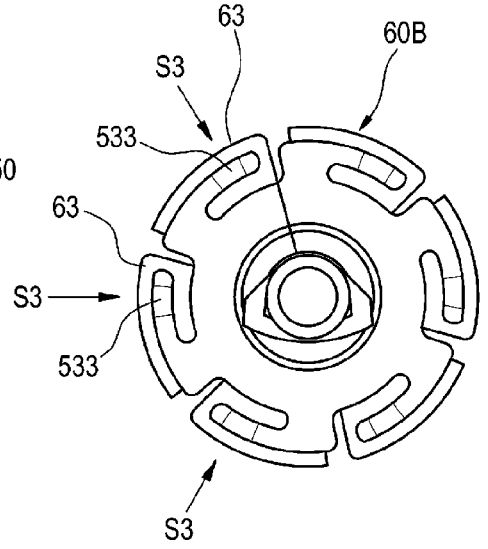
Figure 26A:
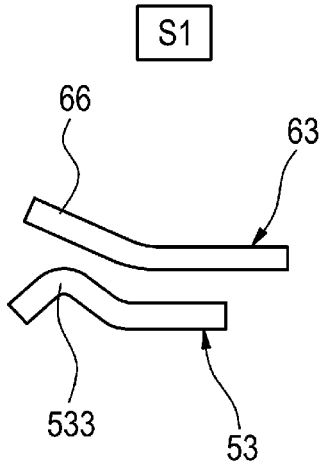
FIGS. 26A to 26C are explanatory views of three modes of the connected state of the contact protrusion and the corresponding contact surface illustrated in FIGS. 25A to 25D.
Figure 26B:
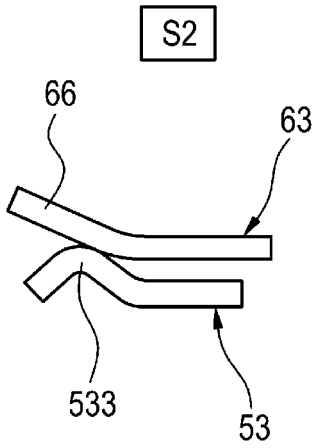
Figure 26C:
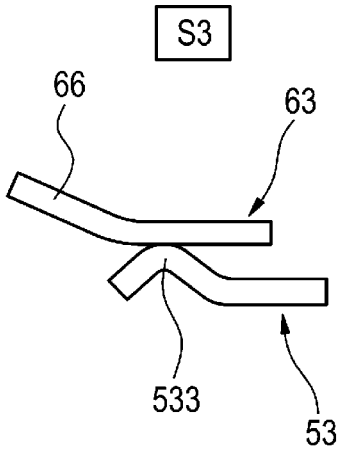

FIGS. 23 to 26C illustrate a terminal fitting connection structure of a third embodiment. FIG. 23 is a perspective view of a third embodiment of the second terminal fitting according to the present invention, and FIG. 24 is a side view of a state in which the second terminal fitting illustrated in FIG. 23 and the first terminal fitting illustrated in FIG. 11 abut each other. FIGS. 25A to 25D are explanatory views of a transition of the connected state during relative rotation between the second terminal fitting of the third embodiment and the first terminal fitting. FIG. 25A is an explanatory view of the connected state in an initial abutting state of the terminal fittings, FIG. 25B is an explanatory view of the connected state in a first stage transited from FIG. 25A by predetermined relative rotation, FIG. 25C is an explanatory view of the connected state in a second stage transited from FIG. 25B by predetermined relative rotation, and FIG. 25D is an explanatory view of a connection completed state transited from FIG. 25C by predetermined relative rotation. In addition, FIGS. 26A to 26C are explanatory views of three modes of the connected state of the contact protrusion and the corresponding contact surface illustrated in FIGS. 25A to 25D.

In the terminal fitting connection structure of the third embodiment, a second terminal fitting 60B is used instead of the second terminal fitting 60 of the first embodiment.

The second terminal fitting 60B is provided with an inclined surface 66 at one edge of each of the plurality of contact surfaces 63 that protrude outward in the radial direction from the outer periphery of the second annular portion 62. The inclined surface 66 is a guide surface which guides the contact protrusion 533 which is inserted into the contact release portion 64 onto the contact surface 63. The inclined surface 66 of this embodiment is provided in one side edge of the contact surface 63 which faces the contact release portion 64.

Furthermore, in the second terminal fitting 60B of the third embodiment, the arrangement of the contact surfaces 63 is set so that portions of the plurality of contact protrusions 533 provided in the first terminal fitting 50 ride on the contact surfaces 63 of the second terminal fitting 60B at timings delayed from those of the other contact protrusions 533.

Specifically, for example, the arrangement of each of the contact surfaces 63 is adjusted so that the contact protrusions 533 that are provided at symmetrical positions with respect to the center axis of the first terminal fitting 50 simultaneously ride on the contact surfaces 63 of the second terminal fitting 60B while the other contact protrusions 533 thereafter ride on the contact surfaces 63 at delayed timings.

The configuration of the second terminal fitting 60 of the first embodiment is common to that of the second terminal fitting 60B of the third embodiment except two points that the inclined surface 66 is provided at one edge of the contact surface 63 and that the arrangement of the contact surfaces 63 is set so as to allow not all the plurality of contact protrusions 533 provided in the first terminal fitting 50 to ride on the contact surfaces 63 at the same timing. Like elements that are common to the second terminal fitting 60 of the first embodiment are denoted by like reference numerals, and descriptions thereof will not be repeated.

In the case of the terminal fitting connection structure of the third embodiment, when the contact protrusions 533 of the first terminal fitting 50 that are inserted into the contact release portions 64 of the second terminal fitting 60B ride on the contact surfaces 63 of the second terminal fitting 60B by the relative rotation between the first terminal fitting 50 and the second terminal fitting 60B, since the contact protrusions 533 move on the inclined surface 66 connected to the contact surface 63, the contact protrusion 533 does not abruptly collide with the edge of the contact surface 63. Furthermore, the bending deformation amount of the contact spring piece 53 which occurs when the contact protrusion 533 rides on the contact surface 63 is gradually changed.

Therefore, the rotating operation force for the contact protrusion 533 of the first terminal fitting 50 to ride on the contact surface 63 of the second terminal fitting 60B can be reduced, and the operability during the rotating operation can be enhanced.

In addition, in the case of the terminal fitting connection structure of the third embodiment, when a connection completed state in which all of the contact protrusions 533 of the first terminal fitting 50 respectively ride on the contact surfaces 63 of the second terminal fitting 60B is achieved from a non-connection state in which all of the contact protrusions 533 of the first terminal fitting 50 are respectively inserted into the contact release portions 64 of the second terminal fitting 60B, as illustrated in FIGS. 25A to 25D, the riding of the contact protrusions 533 on the contact surfaces 63 proceeds in stages.

FIG. 25A illustrates the initial abutting state of the terminal fittings, in which all of the contact protrusions 533 are separated from the inclined surfaces 66 and the contact surfaces 63 as illustrated in FIG. 26A in the non-connection state.

FIG. 25B illustrates a state in which the relative rotation between the terminal fittings proceeds from FIG. 25A. In this state, a portion of the contact protrusion 533 rides on the inclined surface 66 but does not reach the contact surface 63 as illustrated in FIG. 26B. In addition, the connection mode illustrated in FIG. 26A is also present.

FIG. 25C illustrates a state in which the relative rotation between the terminal fittings further proceeds from FIG. 25B. In this state, the portion of the contact protrusion 533 rides on the contact surface 63 as illustrated in FIG. 26C and enters the electrically connected state. However, the connection mode illustrated in FIG. 26B and the connection mode illustrated in FIG. 26A are also present.

FIG. 25D illustrates a state in which the relative rotation between the terminal fittings further proceeds from FIG. 25C and the relative rotation is completed. In this state, all of the contact protrusions 533 ride on the contact surfaces 63 and enter the electrically connected state as illustrated in FIG. 26C.

That is, in the terminal fitting connection structure of the third embodiment, as illustrated in FIGS. 25A to 26C, the operation of causing the contact protrusions 533 of the first terminal fitting 50 to ride on the contact surfaces 63 of the second terminal fitting 60B proceeds in a plurality of stages at delayed timings.

Therefore, compared to the case in which all of the plurality of contact protrusions 533 provided in the first terminal fitting 50 simultaneously ride on the corresponding contact surfaces 63 of the second terminal fitting 60B, as the number of contact protrusions 533 that simultaneously ride on the contact surfaces 63 is reduced, the rotating operation force applied between the two terminal fittings is reduced, and thus the operability can be enhanced.

Description of Terminal Fitting Connection Structure of Fourth Embodiment

Figure 27:
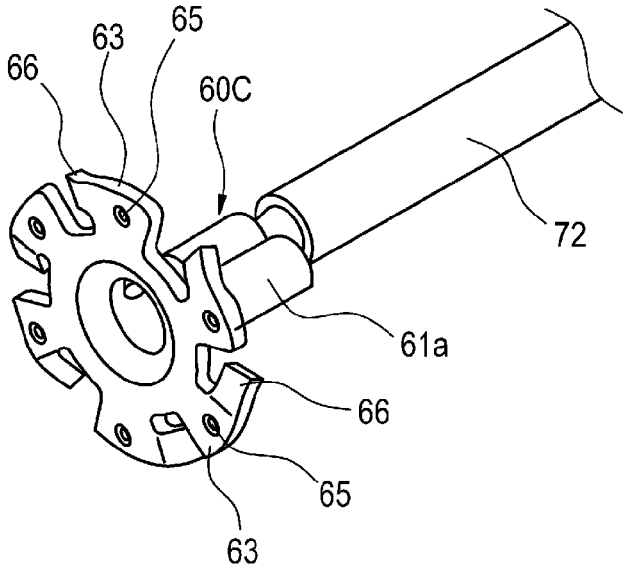
FIG. 27 is a perspective view of a fourth embodiment of the second terminal fitting according to the present invention.
Figure 28:
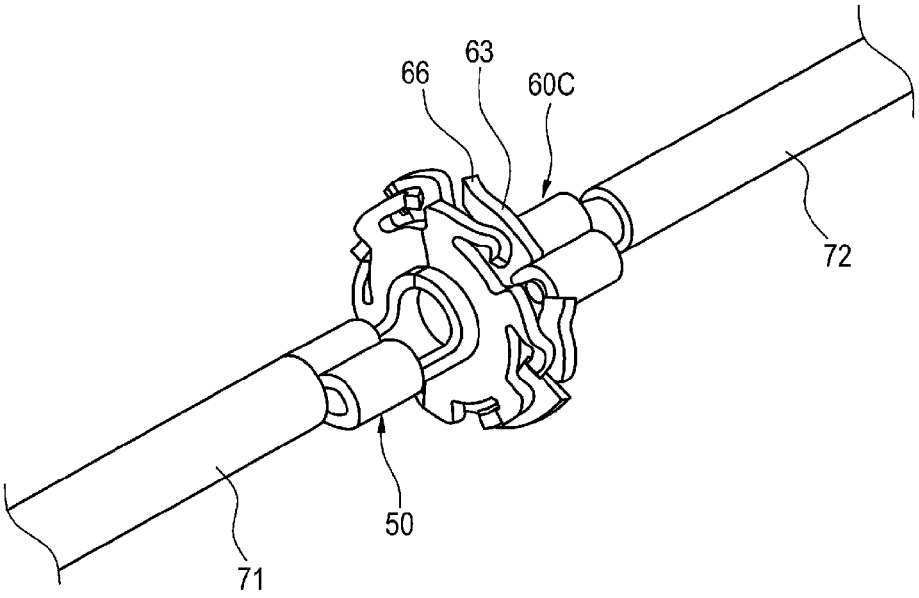
FIG. 28 is a perspective view of a state in which the second terminal fitting illustrated in FIG. 27 and the first terminal fitting illustrated in FIG. 11 abut each other.
Figure 29:
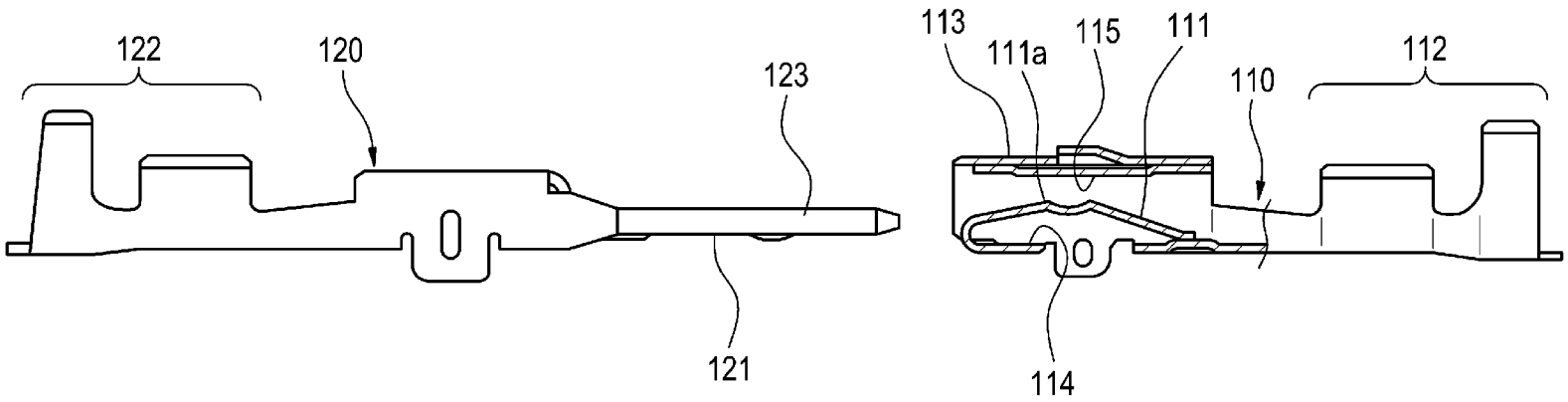
FIG. 29 is an explanatory view of each of terminal fittings connected by a terminal fitting connection structure according to the related art.
Figure 30:
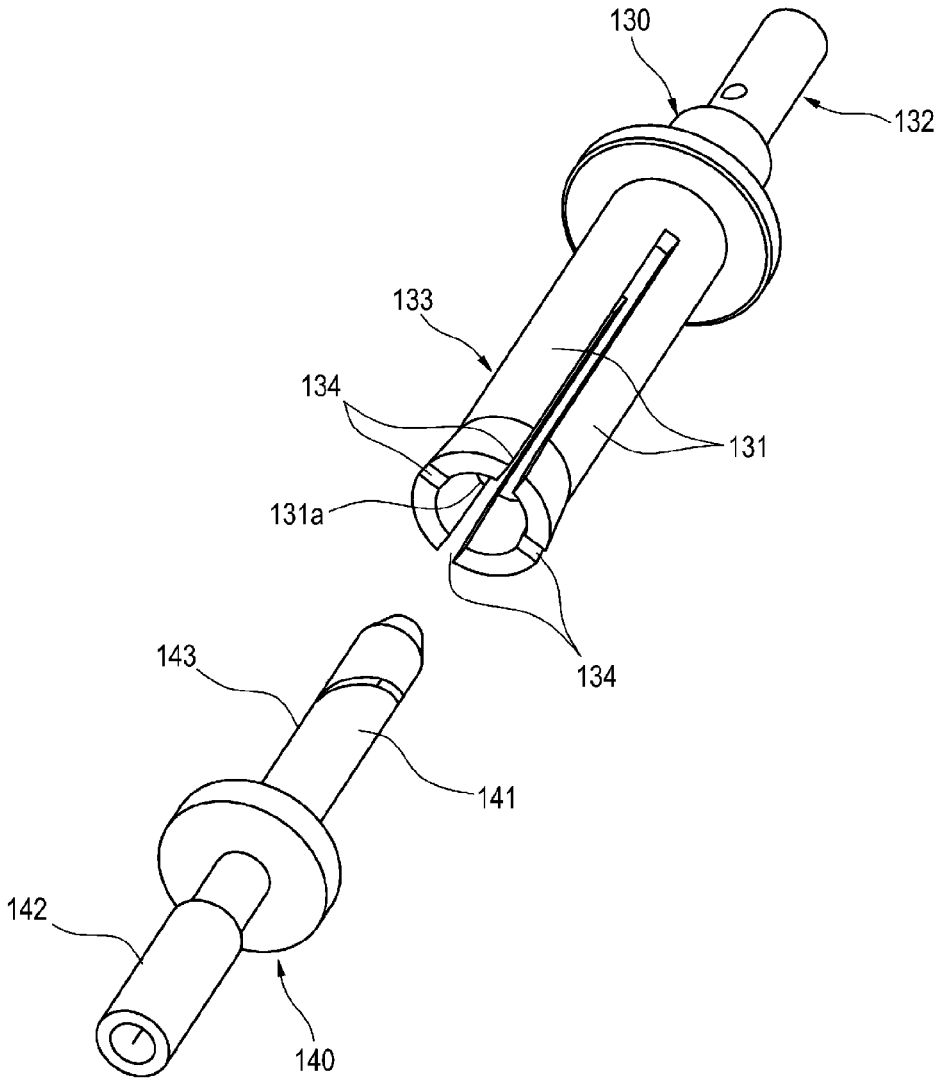
FIG. 30 is an explanatory view of each of terminal fittings connected by another terminal fitting connection structure according to the related art.

FIGS. 27 and 28 illustrate a terminal fitting connection structure of a fourth embodiment. FIG. 27 is a perspective view of a fourth embodiment of the second terminal fitting according to the present invention, and FIG. 28 is a perspective view of a state in which the second terminal fitting illustrated in FIG. 27 and the first terminal fitting illustrated in FIG. 11 abut each other.

In the terminal fitting connection structure of the fourth embodiment, a second terminal fitting 60C is used instead of the second terminal fitting 60 of the first embodiment.

The second terminal fitting 60C is made by adding the recessed portion 65 to the contact surface 63 in the second terminal fitting 60B of the third embodiment. The recessed portion 65 is the same as that provided in the contact surface 63 in the second terminal fitting 60A of the second embodiment. That is, the recessed portion 65 restricts the movement of the contact protrusion 533 as the contact protrusion 533 that rides on the contact surface 63 is fitted to the recessed portion 65.

The configuration of the second terminal fitting 60B of the third embodiment is common to that of the second terminal fitting 60C of the fourth embodiment except that the recessed portions 65 are provided in the contact surfaces 63. Like elements that are common to the third embodiment are denoted by like reference numerals, and descriptions thereof will not be repeated.

In the case of the terminal fitting connection structure of the fourth embodiment, the following actions and effects can be obtained in addition to the actions and effects in the terminal fitting connection structure of the third embodiment.

That is, as illustrated in FIG. 28, the contact protrusion 533 that rides on the contact surface 63 is fitted to the recessed portion 65 provided in the contact surface 63 such that the recessed portion 65 restricts the movement of the contact protrusion 533.

Therefore, slipping of the contact protrusion 533 on the contact surface 63 due to external vibration transmitted from the electric wires 71 and 72 and the like connected to the terminal fittings 50 and 60C can be prevented. As a result, the occurrence of problems such as wear or a reduction in contact pressure caused by the slipping of the contact protrusion 533 on the contact surface 63 can be prevented.

The present invention is not limited to the above-described embodiments, and appropriate modifications, improvements, and the like can be made. In addition, the materials, shapes, dimensions, numbers, arrangement points, and the like of the constituent elements in the above-described embodiments are arbitrary and are not limited as long as the present invention can be accomplished.

For example, in the embodiments, the effect that the arrangement of the contact surfaces 63 in the second terminal fitting is designed to prevent all of the contact protrusions provided in the first terminal fitting from riding on the corresponding contact surfaces of the second terminal fitting at the same timing is described. However, the riding timings may also be delayed by designing the arrangement of the contact protrusions in the first terminal fitting.

In addition, in the embodiments, a configuration in which the connection pins 214 are provided in the first housing body 21 and the axial grooves 315*a*, the peripheral grooves 315*b*, and the locking spring pieces 316 are provided in the second housing body 31 is employed. However, a configuration in which the connection pins 214 are provided in the second housing body 31 and the axial grooves 315*a*, the peripheral grooves 315*b*, and the locking spring pieces 316 are provided in the first housing body 21 may also be employed. In this case, the connection pins 214 provided in the second housing body 31 are provided to protrude inward in the radial direction.

In addition, in the embodiments, a configuration in which the plurality of connection pins 214 and the plurality of locking spring pieces 316 are respectively provided in the housing bodies 21 and 31 is employed. However, only a single connection pin 214 and only a single locking spring piece 316 may also be respectively provided in the housing bodies 21 and 31.

In addition, the locking portion 316 may not be constituted by the spring piece 316*a* and the locking protrusion 316*b* unlike the embodiments, and may also be constituted only by the locking protrusion 316*b* that extends toward the peripheral groove 315*b* without a thinning portion and the spring piece 316*a*. In this case, the connection pin 214 can pass through a portion in the peripheral groove 315*b* narrowed by the locking protrusion 316*b* in a state of coming into pressing contact with the portion.

Here, the features of the embodiments of the terminal fitting connection structure and the rotary fitting type connector according to the present invention described above will be concisely listed in the following [1] to [6].

[1] A terminal fitting connection structure which presses contact spring pieces (53) provided in a first terminal fitting (50) to contact surfaces (63) provided in a second terminal fitting (60) so as to contact thereto, so that the first terminal fitting (50) and the second terminal fitting (60) to enter a state of being electrically connected to each other, in which the first terminal fitting (50) includes a first terminal body (51) which extends on a center axis (M1) of the first terminal fitting (50) and has a base end to which an electric wire (71) is connected substantially coaxially with the center axis (M1) of the first terminal fitting (50), a first annular portion (52) which is formed at a tip end of the first terminal body (51) in an annular shape concentrically with the center axis (M1) of the first terminal fitting (50), and a plurality of the contact spring pieces (53) which are provided at a plurality of points arranged on an outer periphery of the first annular portion (52) at predetermined intervals in a peripheral direction of the first annular portion (52), the contact spring piece (53) includes a spring support portion (531) which extends outward in a radial direction of the first annular portion (52) from the outer periphery of the first annular portion (52), an elastic piece (532) which extends from the spring support portion (531) along the outer periphery of the first annular portion (52) and has a tip end side that is displaceable in a direction of the center axis (M1) of the first terminal fitting (50), and a contact protrusion (533) which protrudes from the elastic piece (532) so as to protrude further toward a mated terminal side than a tip end of the first annular portion (52), and the second terminal fitting (60) includes a second terminal body (61) which extends on a center axis (M2) of the second terminal fitting (60) and has a base end to which an electric wire (72) is connected substantially coaxially with the center axis (M2) of the second terminal fitting (60), a second annular portion (62) which is provided at a tip end of the second terminal body (61) in the same annular shape as that of the first annular portion (52) of the first terminal fitting (50) concentrically with the center axis (M2) of the second terminal fitting (60), a plurality of the contact surfaces (63) which protrude outward in a radial direction of the second annular portion (62) from an outer periphery of the second annular portion (62) at the same intervals as those of the plurality of the contact protrusions (533) in the first terminal fitting (50), and a plurality of contact release portions (64) which are positioned between the adjacent contact surfaces (63) and allow the contact protrusions (533) to be inserted into the contact release portions (64).

[2] The terminal fitting connection structure described in [1], in which the plurality of the contact surfaces (63) of the second terminal fitting (60) are provided with recessed portions (65) to which the contact protrusions (533) that ride on the contact surfaces (63) are fitted.

[3] The terminal fitting connection structure described in [1] or [2], in which one side edge of each of the plurality of the contact surfaces (63) of the second terminal fitting (60), which faces the contact release portion (64), is provided with an inclined surface (66) which guides the contact protrusion (533) that is inserted into the contact release portion (64) onto the contact surface (63).

[4] The terminal fitting connection structure described in any one of [1] to [3], in which an arrangement of the contact protrusions (533) and the contact surfaces (63) is set so that portions of the plurality of the contact protrusions (533) provided in the first terminal fitting (50) ride on the contact surfaces (63) of the second terminal fitting (60) at timings different from those of the other contact protrusions (533).

[5] A rotary connector (10) which allows terminal fittings to enter a state of being electrically connected to each other by using the terminal fitting connection structure described in any one of [1] to [4], the rotary connector comprising:

a first connector housing (20) which includes a first housing body (21) which fixes and supports the first terminal fitting (50) on a center axis (C1) so as to expose a tip end portion of the first terminal fitting (50) that is fixed and supported from a front end of the first housing body (21), and has a circular section that is concentric with the center axis (C1), and a connection pin (214) which protrudes from the first housing body (21) along a radial direction thereof; and a second connector housing (30) which includes a second housing body (31) which fixes and supports the second terminal fitting (60) on the center axis (C1) so as to expose a tip end portion of the second terminal fitting (60) that is fixed and supported from a front end of the second housing body (31), has a circular section that is concentric with the center axis (C1), and is fitted to the first housing body (21), an axial groove (315*a*) which is cut out from an end portion of the second housing body (31) on the first connector housing (20) side so as to extend along a center axis direction of the second housing body (31), and allows the connection pin (214) to be inserted into the axial groove (315*a*) when the first housing body (21) is fitted to the second housing body (31) along the center axis direction of the second housing body (31), a peripheral groove (315*b*) which extends from an end of the axial groove (315*a*) toward one side in a peripheral direction of the second housing body (31) along the peripheral direction to have a predetermined length, and allows the connection pin (214) to move in the peripheral groove (315*b*) when the first housing body (21) and the second housing body (31) are rotated relative to each other, and a locking portion (316) which comes into contact with the connection pin (214) from a start side of the peripheral groove (315*b*) when the connection pin (214) reaches an end of the peripheral groove (315*b*) and restricts movement of the connection pin (214) in a return direction, thereby locking a joined state of the connector housings.

[6] A rotary connector (10) which allows terminal fittings to enter a state of being electrically connected to each other by using the terminal fitting connection structure described in any one of [1] to [4], including:

a first connector housing (20) which includes a first housing body (21) which fixes and supports the first terminal fitting (50) on a center axis (C1) to allow a tip end portion of the first terminal fitting (50) that is fixed and supported, to be exposed from a front end of the first housing body (21), a barrel portion (212) which is formed on an outer periphery of the first housing body (21) and has a circular outer periphery that is concentric with the center axis (C1) of the first housing body (21), and a connection pin (214) which protrudes outward in a radial direction from the outer periphery of the barrel portion (212); and a second connector housing (30) which includes a second housing body (31) which fixes and supports the second terminal fitting (60) on a center axis (C2) to allow a tip end portion of the second terminal fitting (60) that is fixed and supported, to be exposed from a front end of the second housing body (31), a cylindrical portion (312) which protrudes toward a front end portion of the second housing body (31) in a cylindrical shape that is concentric with the center axis (C2) of the second housing body (31), and is fitted to the barrel portion (212) of the first connector housing (20), an axial groove (315*a*) which is formed to be cut out from an opening end of the cylindrical portion (312) so as to extend along a direction of a center axis (O3) of the cylindrical portion (312), and allows the connection pin (214) to be inserted into the axial groove (315*a*) when the barrel portion (212) is fitted to the cylindrical portion (312) along the direction of the center axis (O3) of the cylindrical portion (312), a peripheral groove (315*b*) which extends from an end of the axial groove (315*a*) toward one side in a peripheral direction of the cylindrical portion (312) along the peripheral direction to have a predetermined length, and allows the connection pin (214) to move in the peripheral groove (315*b*) when the cylindrical portion (312) and the barrel portion (212) are rotated relative to each other, and a locking spring piece (316) which elastically comes into contact with the connection pin (214) from a start side of the peripheral groove (315*b*) when the connection pin (214) reaches an end of the peripheral groove (315*b*) and restricts movement of the connection pin (214) in a return direction, thereby locking a joined state of the connector housings.

While the present invention has been described in detail with reference to the specific embodiments, it should be noted by those skilled in the art that various changes and modifications can be added without departing from the spirit and scope of the present invention.

According to the terminal fitting connection structure in the present invention, a reduction in the size of a connector which accommodates terminal fittings can be achieved by reducing the axial length of the terminal fittings, and the reliability of electrical connection can be enhanced by reducing the conductor resistance in contact portions of the terminal fittings. The present invention that exhibits this effect is useful in a terminal fitting connection structure, and a rotary fitting type connector which electrically connects terminal fittings to each other using the terminal fitting connection structure.

What is claimed is:

1. A terminal fitting connection structure which presses contact spring pieces provided in a first terminal fitting to contact surfaces provided in a second terminal fitting so as to contact thereto, so that the first terminal fitting and the second terminal fitting are electrically connected to each other, wherein the first terminal fitting includes:

a first terminal body which extends on a center axis of the first terminal fitting and has a base end to which an electric wire is connected substantially coaxially with the center axis of the first terminal fitting, a first annular portion which is formed at a tip end of the first terminal body in an annular shape concentrically with the center axis of the first terminal fitting, and a plurality of the contact spring pieces which are provided at a plurality of points arranged on an outer periphery of the first annular portion at predetermined intervals in a peripheral direction of the first annular portion, the contact spring piece includes:

a spring support portion which extends outward in a radial direction of the first annular portion from the outer periphery of the first annular portion, an elastic piece which extends from the spring support portion along the outer periphery of the first annular portion and has a tip end side that is displaceable in a direction of the center axis of the first terminal fitting, and a contact protrusion which protrudes from the elastic piece so as to protrude further toward a mated terminal side than a tip end of the first annular portion, and the second terminal fitting includes:

a second terminal body which extends on a center axis of the second terminal fitting and has a base end to which an electric wire is connected substantially coaxially with the center axis of the second terminal fitting, a second annular portion which is provided at a tip end of the second terminal body in the same annular shape as that of the first annular portion of the first terminal fitting concentrically with the center axis of the second terminal fitting, a plurality of the contact surfaces which protrude outward in a radial direction of the second annular portion from an outer periphery of the second annular portion at the same intervals as those of the plurality of the contact protrusions in the first terminal fitting, and a plurality of contact release portions which are positioned between the adjacent contact surfaces and allow the contact protrusions to be inserted into the contact release portions.

2. The terminal fitting connection structure according claim 1, wherein the plurality of the contact surfaces of the second terminal fitting are provided with recessed portions to which the contact protrusions that ride on the contact surfaces are fitted.

3. The terminal fitting connection structure according to claim 1, wherein one side edge of each of the plurality of the contact surfaces of the second terminal fitting, which faces the contact release portion, is provided with an inclined surface which guides the contact protrusion that is inserted into the contact release portion onto the contact surface.

4. The terminal fitting connection structure according to claim 1, wherein an arrangement of the contact protrusions and the contact surfaces is set so that portions of the plurality of the contact protrusions provided in the first terminal fitting ride on the contact surfaces of the second terminal fitting at timings different from those of the other contact protrusions.

5. A rotary connector which allows terminal fittings to enter a state of being electrically connected to each other by using the terminal fitting connection structure according to claim 1, the rotary connector comprising:

a first connector housing which includes a first housing body which fixes and supports the first terminal fitting on a center axis so as to expose a tip end portion of the first terminal fitting that is fixed and supported from a front end of the first housing body, and has a circular section that is concentric with the center axis, and a connection pin which protrudes from the first housing body along a radial direction thereof; and a second connector housing which includes a second housing body which fixes and supports the second terminal fitting on the center axis so as to expose a tip end portion of the second terminal fitting that is fixed and supported from a front end of the second housing body, has a circular section that is concentric with the center axis, and is fitted to the first housing body, an axial groove which is cut out from an end portion of the second housing body on the first connector housing side so as to extend along a center axis direction of the second housing body, and allows the connection pin to be inserted into the axial groove when the first housing body is fitted to the second housing body along the center axis direction of the second housing body, a peripheral groove which extends from an end of the axial groove toward one side in a peripheral direction of the second housing body along the peripheral direction to have a predetermined length, and allows the connection pin to move in the peripheral groove when the first housing body and the second housing body are rotated relative to each other, and a locking portion which comes into contact with the connection pin from a start side of the peripheral groove when the connection pin reaches an end of the peripheral groove and restricts movement of the connection pin in a return direction, thereby locking a joined state of the connector housings.

* * * * *